US010007221B2

(12) United States Patent
Kikegawa

(10) Patent No.: US 10,007,221 B2
(45) Date of Patent: Jun. 26, 2018

(54) IMAGE FORMING APPARATUS TO CONTROL SUPPLY OF EVEN ABNORMAL LEVELS OF A TRANSFER VOLTAGE, BASED UPON TEMPERATURE DETECTED

(71) Applicant: Ryuichi Kikegawa, Kanagawa (JP)

(72) Inventor: Ryuichi Kikegawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days. days.

(21) Appl. No.: 15/333,217

(22) Filed: Oct. 25, 2016

(65) Prior Publication Data

US 2017/0131663 A1 May 11, 2017

(30) Foreign Application Priority Data

Nov. 9, 2015 (JP) ..... 2015-219027
Sep. 21, 2016 (JP) ..... 2016-184747

(51) Int. Cl.
*G03G 15/00* (2006.01)
*G03G 15/16* (2006.01)

(52) U.S. Cl.
CPC ..... *G03G 15/55* (2013.01); *G03G 15/1675* (2013.01); *G03G 2215/00772* (2013.01)

(58) Field of Classification Search
CPC ..... G03G 21/20; G03G 15/55; G03G 15/1675
USPC ..... 399/40, 66, 44
See application file for complete search history.

(56) References Cited

U.S. PATENT DOCUMENTS

2006/0039713 A1 2/2006 Kishi et al.
2006/0051111 A1 3/2006 Kishi et al.
2006/0051112 A1 3/2006 Matsusaka et al.
2006/0051113 A1 3/2006 Kishi et al.
2006/0051119 A1 3/2006 Kishi et al.
2006/0051120 A1 3/2006 Kishi et al.
2006/0051121 A1 3/2006 Matsusaka et al.
2006/0127118 A1 6/2006 Kishi et al.
(Continued)

FOREIGN PATENT DOCUMENTS

JP 2002-278321 9/2002
JP 2003-208062 7/2003
(Continued)

OTHER PUBLICATIONS

English machine-translation of description to JP 2015-094782.*

*Primary Examiner* — Walter L Lindsay, Jr.
*Assistant Examiner* — Arlene Heredia Ocasio
(74) *Attorney, Agent, or Firm* — Harness, Dickey & Pierce, P.L.C.

(57) ABSTRACT

An image forming apparatus includes an image bearer on which an image is formed; a transfer device to form a transfer portion between the image bearer and the transfer device; a voltage application device to apply a transfer voltage to the transfer device to transfer the image from the image bearer to a transfer target at the transfer portion; an abnormality sensor to detect an abnormal level of the transfer voltage; a temperature sensor to detect an ambient temperature; and a control circuit. The control circuit controls the voltage application device to continue applying the transfer voltage irrespective of whether the abnormality sensor has detected the abnormal level of the transfer voltage when a detection temperature of the temperature sensor is below a predetermined temperature.

19 Claims, 17 Drawing Sheets

(56) References Cited

U.S. PATENT DOCUMENTS

| | | | |
|---|---|---|---|
| 2008/0145088 | A1 | 6/2008 | Matsusaka et al. |
| 2009/0196643 | A1 | 8/2009 | Mito et al. |
| 2013/0236220 | A1 | 9/2013 | Mito et al. |

FOREIGN PATENT DOCUMENTS

| | | |
|---|---|---|
| JP | 2005-258287 | 9/2005 |
| JP | 2015-060101 | 3/2015 |
| JP | 2015-094782 | 5/2015 |

* cited by examiner

IMAGE FORMING APPARATUS TO CONTROL SUPPLY OF EVEN ABNORMAL LEVELS OF A TRANSFER VOLTAGE, BASED UPON TEMPERATURE DETECTED

CROSS-REFERENCE TO RELATED APPLICATIONS

This patent application is based on and claims priority pursuant to 35 U.S.C. § 119(a) to Japanese Patent Application Nos. 2015-219027, filed on Nov. 9, 2015, and 2016-184747, filed on Sep. 21, 2016, in the Japan Patent Office, the entire disclosure of each of which is hereby incorporated by reference herein.

BACKGROUND

Technical Field

Exemplary aspects of the present disclosure generally relate to an image forming apparatus, such as a copier, a facsimile machine, a printer, or a multi-functional system including a combination thereof.

Background Art

There have been known techniques for controlling a transfer voltage according to temperature in an electrophotographic image forming apparatus, such as a copier, a facsimile (FAX), a printer, and a multifunction peripheral (MFP) including a combination thereof, that includes a contact-transfer device. For example, the technique for increasing a transfer voltage at low temperatures has been known.

SUMMARY

In an aspect of this disclosure, there is provided an image forming apparatus including an image bearer on which an image is formed; a transfer device to form a transfer portion between the image bearer and the transfer device; a voltage application device to apply a transfer voltage to the transfer device to transfer the image from the image bearer to a transfer target at the transfer portion; an abnormality sensor to detect an abnormal level of the transfer voltage; a temperature sensor to detect an ambient temperature; and a control circuit. The control circuit controls the voltage application device to continue applying the transfer voltage irrespective of whether the abnormality sensor has detected the abnormal level of the transfer voltage when a detection temperature of the temperature sensor is below a predetermined temperature.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
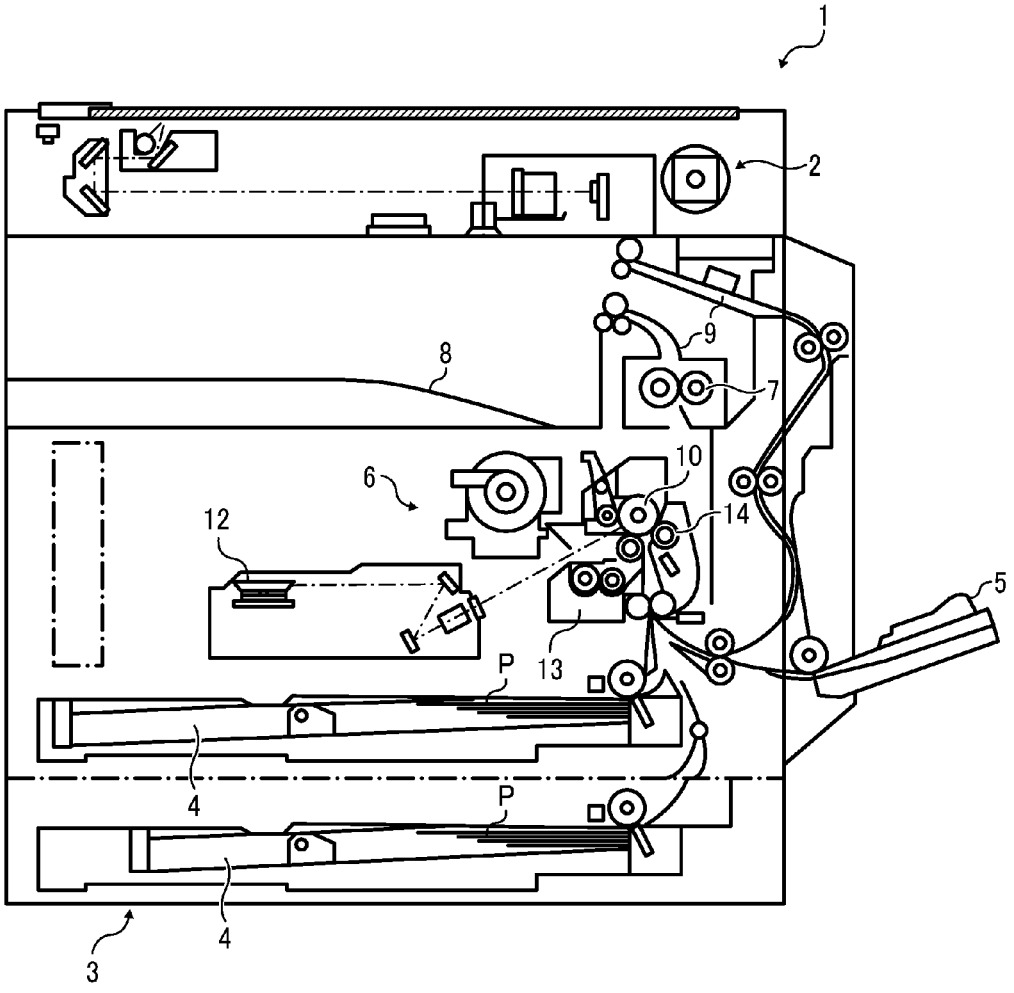
FIG. 1 is a vertical cross-sectional view of an image forming apparatus illustrated as a copier, according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

When an inexpensive high-voltage power source (HVP) is used for such a transfer device, the resistance of a transfer roller increases at low temperatures of, e.g., lower than or equal to 5° C. Further, the transfer bias increases when constant current control is performed. Accordingly, an abnormal output from the HVP occurs, resulting in the image forming apparatus that includes the transfer device stopping the operation. Note that the described-above inexpensive HVP serves to lower the maximum voltage, thereby reducing costs. For example, typical HVPs output a voltage of 7 kV at maximum while inexpensive HVPs outputs a voltage of 5 kV at maximum. Note that in the following description, "the above-described machinery" refers to an image forming apparatus and "the above-described machine down" refers to that an image forming apparatus stops the operation such as image formation.

The above-described abnormal output from the HVP occurs due to the following circumstances.

The resistance of the transfer roller increases at temperatures of lower than or equal to 5° C. and such an increase in resistance does not occur at a temperature of 10° C. and a humidity of 15%. Further, the transfer voltage exceeds the maximum value when constant current control is performed, so that the HVP outputs an abnormal voltage, resulting in a stop of the operation of the image forming apparatus. Such abnormalities often occur particularly because the upper limit output of inexpensive HVPs is low.

According to embodiments of the present disclosure, a voltage detection control is prohibited at lower temperatures that are lower than a predetermined value to prevent a high-voltage power source from outputting abnormal voltage, thus preventing stopping the operation of an image forming apparatus employed.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

A description is provided of embodiments of the present disclosure below.

FIG. 1 is a schematic vertical cross-sectional view of an image forming apparatus 1, which is illustrated as a copier, according to an embodiment of the present disclosure. The image forming apparatus 1 includes a scanner 2 and a printer 3. The scanner 2 is disposed at an upper side of the image forming apparatus 1. The printer 3 forms an image of an original document scanned by the scanner 2 on a transfer target, e.g., a sheet of paper. Within the printer 3 is formed a sheet conveyance passage 9 that connects from a sheet feeding tray 4 or a side tray 5 to a sheet ejection stacker 8 via a printer engine 6 and a fixing device 7. The sheet feeding tray 4 holds a stack of sheets P as recording media (a recording medium), and the side tray 5 receives sheets P manually placed by a user.

Figure 2:
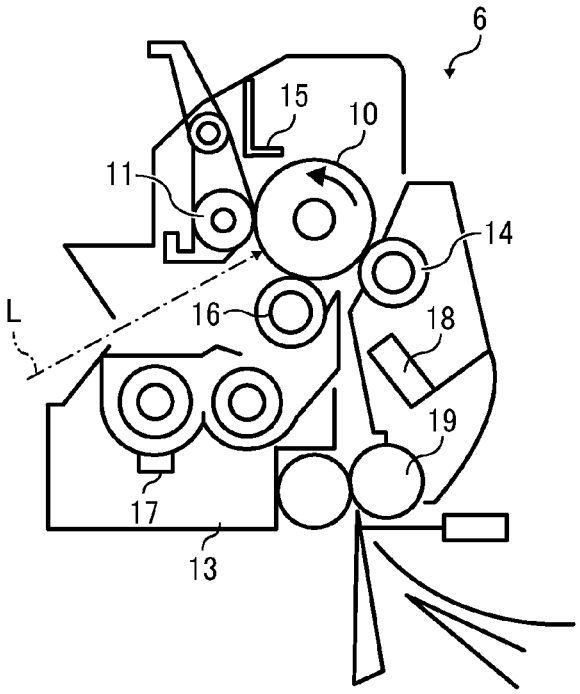
FIG. 2 is an enlarged front view of a configuration around a photoconductor in a printer engine illustrated in FIG. 1.

FIG. 2 is an enlarged front view of a configuration around a drum-shaped photoconductor 10 in the printer engine 6.

Around the photoconductor 10 as an example of an image bearer are disposed a charging roller 11, a developing device 13, a transfer roller 14 as a contact transfer device, a voltage application device to apply a transfer voltage to the transfer device, and a cleaning blade 15 in the recited order. Further, a position at which a laser beam L output from a writing device 12 (FIG. 1) irradiates the photoconductor 10 (the photoconductor 10 is exposed to the light beam L) is indicated. The developing device 13 includes a developing sleeve 16 and a toner concentration sensor 17. The printer engine 6 further includes a P sensor 18 and a registration roller 19. The P sensor 18 detects a toner concentration of a toner image formed on the photoconductor 10. The registration roller 19 controls the timing of feeding a sheet P to a transfer position.

In such a configuration, the charging roller 11 uniformly supplies electric charge to the surface of the photoconductor 10 so that the surface of the photoconductor 10 is uniformly charged at a constant potential. The writing device 12 irradiates the charged surface of the photoconductor 10 with the writing light beam L to form an electrostatic latent image on the surface. The formed electrostatic latent image passes through the developing device 13, thereby forming a toner image on the photoconductor 10. The transfer roller 14 transfers the toner image from the photoconductor 10 onto a sheet P having been fed from the feeding tray 4 and sent by the registration roller 19 to the photoconductor 10 while the sheet P passes through a transfer portion. The transferred toner image is melted and fixed by the fixing device to the sheet P.

The following describes a contact transfer method employed in the image forming apparatus 1 according to the present embodiment of this disclosure.

In the contact transfer method according to the present embodiment, the transfer roller 14 is a transfer device that employs the contact transfer device. The transfer roller 14 has a resistance ranging from $10^7$ through $10^9\Omega$ with a direct current (DC) of 500 V under ordinary-temperature and ordinary-humidity condition (at, for example, a temperature of 23° C. and a relative humidity (Rh) of 50%). In general, the resistance increases at low-temperature and low-humidity condition and the resistance decreases at high-temperature and high-humidity condition. Such change in resistance with temperature and humidity is likely to apply to sheets of paper. Thus, in the transfer device with the constant current control, a transfer bias to be applied to the transfer roller 14 is adjusted such that a constant value of current flows through the sheet P passing through the transfer portion.

In the transfer process, the toner image is electrostatically attracted from the photoconductor 10 onto the front surface of the sheet P by applying electric charges having an opposite polarity to the polarity of toner to the back side of the sheet P. Adjusting the amount of transfer current to be constant applies a sufficient amount of electrical charge to the back side of the sheet P to attract the toner image to the surface of the sheet P irrespective of temperature and humidity. With an insufficient amount of current applied, the toner image is not successfully attracted to the front surface of the sheet P, resulting in an unsuccessful printed image due to transfer failure. With an excessive amount of current applied, an electrical discharge may occur at and around the transfer portion due to a great potential difference, resulting in the occurrence of abnormalities, such as inverse of the polarity of toner and the distortion of latent images or transferred images. To deal with different sizes of sheets P, an increased amount of current is applied to the back surface of the sheet P, thereby supplying a sufficient electric charge to the back side of the sheet P to successfully attract the toner image from the photoconductor 10 to the front surface of the sheet P in consideration of the current that is more likely to flow out at portions where the transfer roller 14 directly contacts the photoconductor 10.

In order to handle such a situation, a suitable value of the transfer current is typically set according to a sheet size.

Some electrophotographic image forming apparatuses include a temperature-humidity sensor within the apparatus to change the transfer conditions according to a detection value of the sensor. However, this increases cost. In the image forming apparatuses without such temperature-humidity sensor, appropriate transfer conditions are preferably created in consideration of changes in the environment and an increase in resistance of the second surface (back surface)

of a sheet to prevent the occurrence of abnormalities with changes in temperature and humidity.

Embodiment 1

Figure 3:
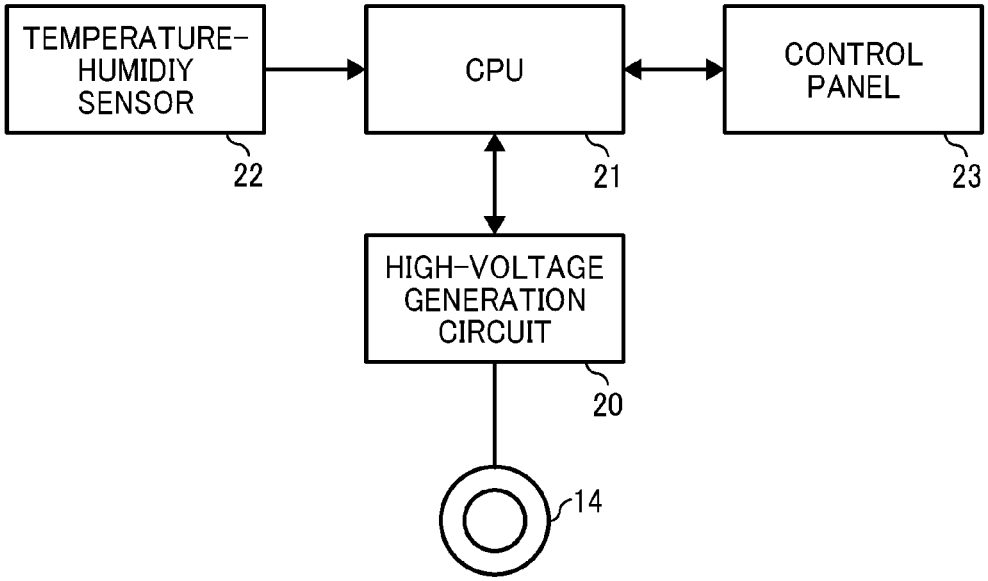
FIG. 3 is a block diagram of an example configuration of a power-source and control system for a transfer roller in the image forming apparatus according to a first embodiment of the present disclosure.

A description is given of a control mechanism in the above-described configuration according to the first embodiment of the present disclosure, with reference to FIG. 3. FIG. 3 is a block diagram of an example configuration of a power-source and control system for the transfer roller 14 in the image forming apparatus 1 with a temperature-humidity sensor 22.

The image forming apparatus 1 includes a high-voltage generation circuit 20 as a voltage application device to apply a transfer voltage to the transfer roller 14. The image forming apparatus 1 further includes a control unit including a central processing unit (CPU) 21 as a control circuit to perform an abnormality detection process to be described below. The CPU 21 includes a CPU circuit to control the operation of applying a transfer voltage to the transfer roller 14 with the constant current control method.

The image forming apparatus 1 further includes a control panel 23. The control panel 23 includes a liquid crystal display (LCD) display, a buzzer, various keys, such as a keypad and buttons. The LCD display and the buzzer constitute a sound generator as an alarm. The various keys, such as a keypad, and the buttons serves as a selection device. The temperature-humidity sensor 22 in FIG. 3 serve as a temperature sensor and a humidity sensor.

As illustrated in FIG. 3, the CPU 21, the temperature-humidity sensor 22, the control panel 23, and the high-voltage generation circuit 20 are electrically connected to each other.

Note that the control unit, which includes the CPU 21 as a control circuit, includes the following control mechanism. That is, the control unit includes a micro computer (one or more processors) that includes the CPU 21 serving as a calculator and a control circuit, a random access memory (RAM), a read only memory (ROM), and a timer. The above-described RAM temporarily stores the calculations of the CPU 21 and various pieces of data. In some embodiments, the control unit may includes an erasable programmable read-only memory (EPROM) and an electrically erasable and programmable read only memory (EEPROM), instead of the ROM.

Figure 4:
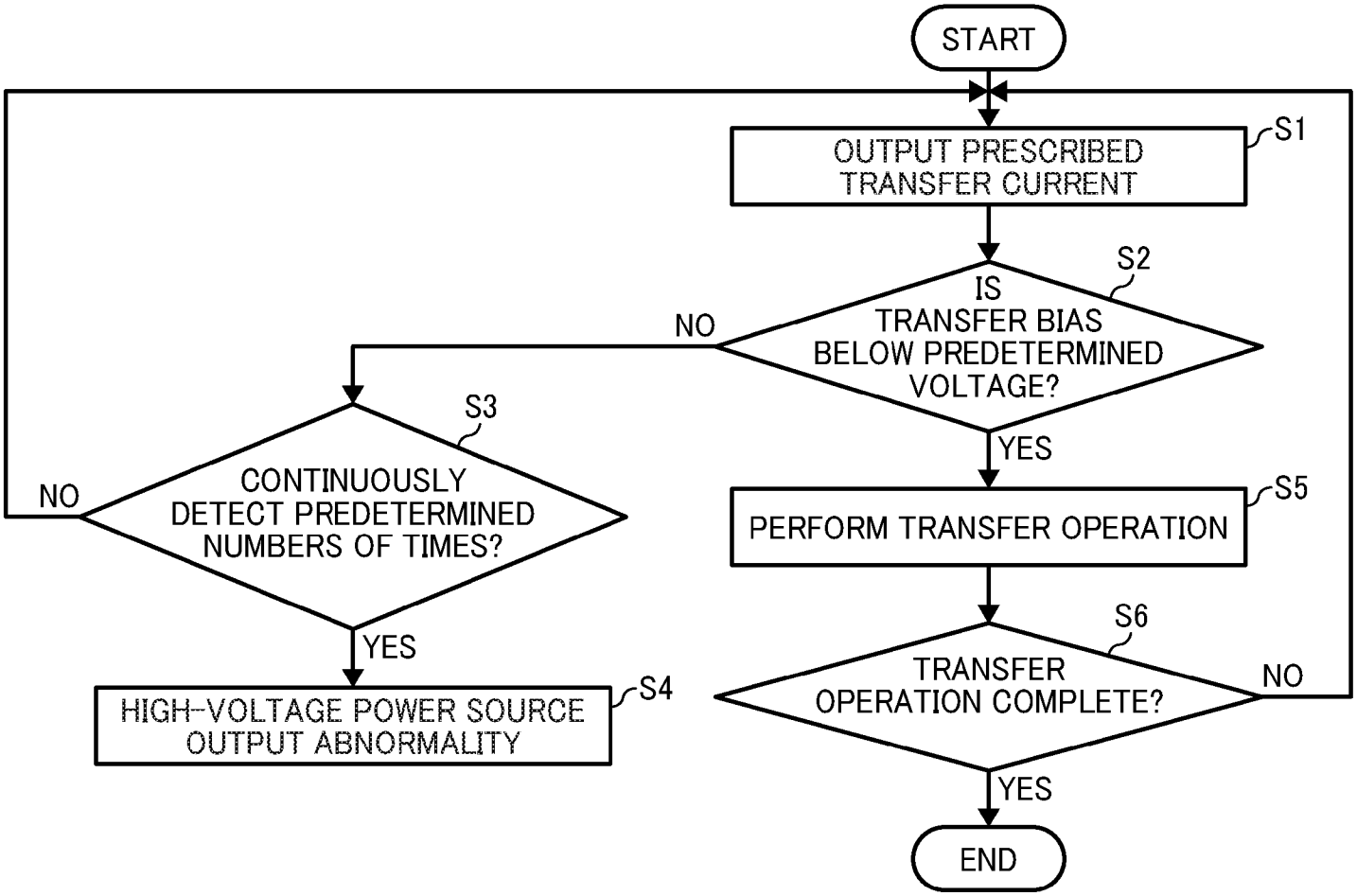
FIG. 4 is a flowchart of the operation sequence when a high-voltage power source outputs abnormal voltage in a normal control mode.

The following describes a normal control operation sequence that is performed when the high-voltage power source (the high-voltage generation circuit 20) outputs abnormal voltage according to the first embodiment of the present disclosure, referring to FIG. 4.

As illustrated in FIG. 4, the CPU 21 causes the high-voltage generation circuit 20 to output a prescribed transfer current (step S1). Then, the CPU 21 determines whether the transfer bias is less than a predetermined voltage (in other words, whether the transfer bias is greater than or equal to the predetermined voltage) at an interval of t1 seconds (in step S2). In step S3, the CPU 21 determines whether the transfer device has been detected a predetermined number of times. When an affirmative determination is made in step S3 (the transfer voltage is detected the predetermined number of times in succession), the CPU 21 determines that the high-voltage power source outputs an abnormal voltage (high-voltage power source output abnormality) and stops the image forming operation, turning on the serviceman's call on the control panel 23 (step S4). When an affirmative determination is made in step S2 (the transfer bias is below the predetermined voltage) as well, the CPU 21 executes the transfer process in step S5, and terminates the transfer process in step S6.

Note that when a negative determination is made in step S3, that is, the transfer bias has not been detected at an interval of t1 seconds the predetermined number of times in succession, the operation goes back to step S1 and the CPU 21 controls the high-voltage generation circuit 20 to output a prescribed transfer current. Further, when a negative determination is made in step S6 and the transfer process is not terminated, the operation goes back to step S1 and the CPU controls the high-voltage generation circuit 20 to output a prescribed transfer current.

Figure 5:
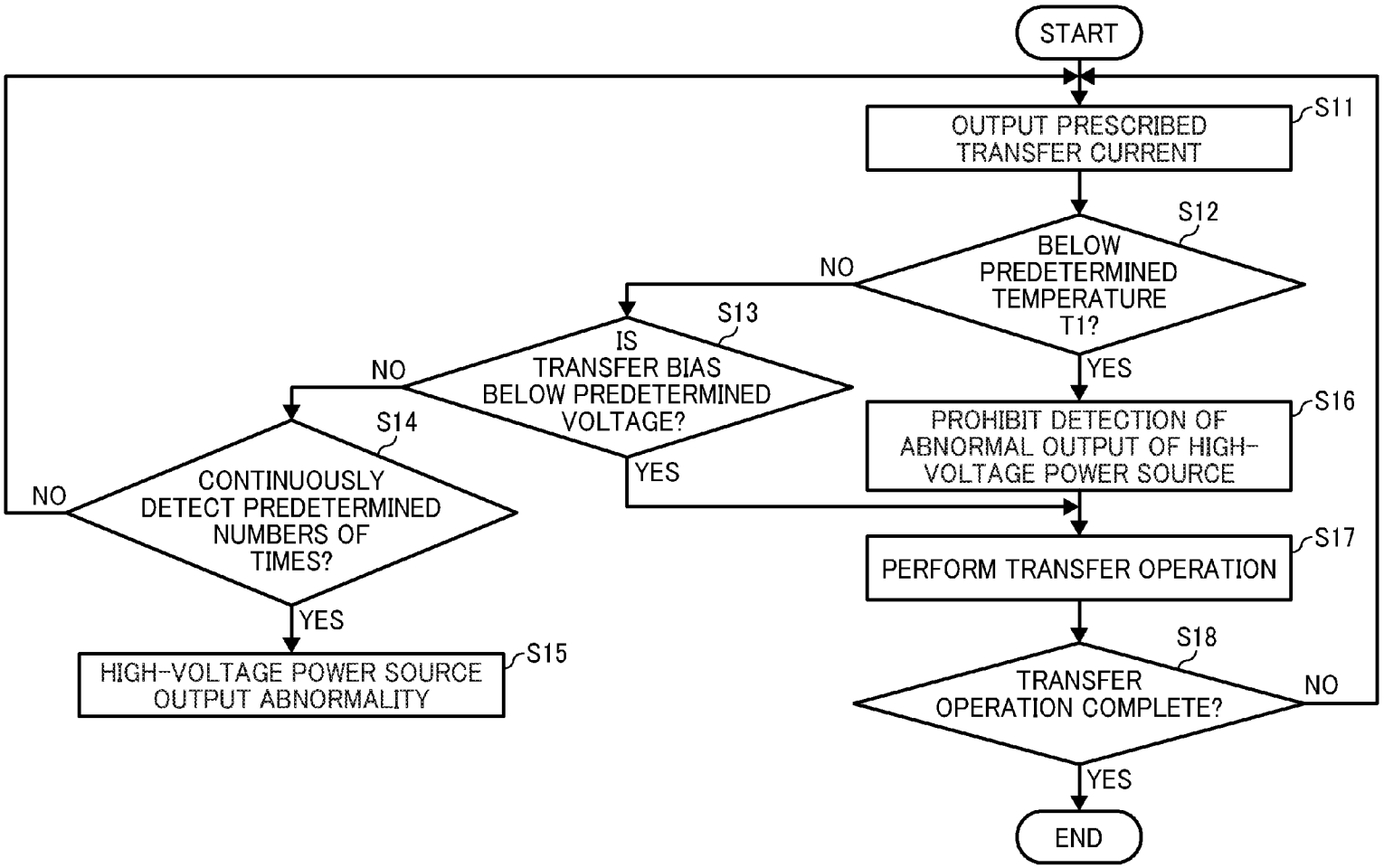
FIG. 5 is a flowchart of an operation sequence according to the first embodiment.

The following mainly describes differences from the normal control operation sequence according to the first embodiment as illustrated in FIG. 4, referring to FIG. 5.

In FIG. 5, the operation sequence starts from step S11. The operation sequence of FIG. 5 differs from the normal control operation sequence of FIG. 4 in that the temperature-humidity sensor 22 (in some embodiments, the sensor serves only as the temperature sensor) in the interior of the image forming apparatus 1 detects ambient temperature and the CPU 21 determines whether a detection temperature is below a predetermined temperature T1 in step S12 of FIG. 5. Further, the operation sequence of FIG. 5 differs from the normal control sequence of FIG. 4 in that when the CPU determines that a detection temperature is below the predetermined temperature T1 in step S12 of FIG. 5, the operation goes to step S16 to be described below.

When a negative determination is made in step S12 (a detection temperature is greater than or equal to the predetermined temperature T1), the operation goes to step S13. The operations in step S13 through step S15 are the same as the operations in step S2 through step S4. That is, the CPU 21 determines whether the transfer bias is less than a predetermined voltage at an interval of t1 seconds (in step S13). When a negative determination is made, the CPU 21 determines whether the transfer voltage is detected a predetermined number of times in succession. When an affirmative determination is made in step S14 (the transfer voltage is detected the predetermined numbers of times) in succession, the CPU 21 determines that the high-voltage power source (the high-voltage generation circuit 20) outputs abnormal voltage (hereinafter referred to as "abnormal voltage of the high-voltage power source") and stops the high-voltage output of the high-voltage generation circuit 20 and shuts down the image forming apparatus, turning on serviceman's call on the control panel 23 (step S15).

When an affirmation determination is made in step S12 (the detected temperature is below a predetermined temperature T1, the CPU 21 prohibits the voltage detection control (masking) and the detection of abnormal voltage of the high-voltage power source in step S16 to prevent the high-voltage power source from outputting an abnormal voltage. Then, the CPU 21 executes the transfer process in step S17, and terminates the transfer process in step S18. When an affirmative determination is made in step S13 (the transfer bias is below the predetermined voltage) as well, the CPU 21 executes the transfer process in step S17, and terminates the transfer process in step S18. For this reason, the image forming apparatus does not stop operating at a low temperature below the predetermined temperature T1. Note that the text "PROHIBIT DETECTION OF ABNORMAL VOLTAGE OF HIGH-VOLTAGE POWER SOURCE" in step S16 is also referred to as "prohibit abnormality detection process" that is described in the description of a flowchart of the operation sequence below.

When the detected temperature is greater than or equal to the predetermined temperature, the CPU 21 sets the control operation back to the normal control operation of FIG. 4 and removes the prohibition of the control for detection voltage. In starting up an apparatus in the cold early morning with a heater off, it is assumed to be at low temperature less than a predetermined temperature (particularly, after a holiday). When the heater is turned on, the ambient temperature gradually increases so that the detected temperature may be greater than the predetermined temperature sometimes. In such cases, the CPU 21 sets the control operation back to the normal control operation. When the detected temperature by the temperature-humidity sensor 22 becomes greater than the predetermined temperature T1, the CPU 21 sets the control operation back to the normal control operation because even an output abnormality of a high-voltage power source does not occur even with the low-cost high-voltage power source, so as to prevent generating an abnormal image. With such a configuration, the image forming apparatus 1 remains active without stopping the operation at low temperatures below the predetermined temperature that sometimes occurs, and switches the control operation to the normal control operation at temperatures not less than the predetermined temperature.

Figure 6:
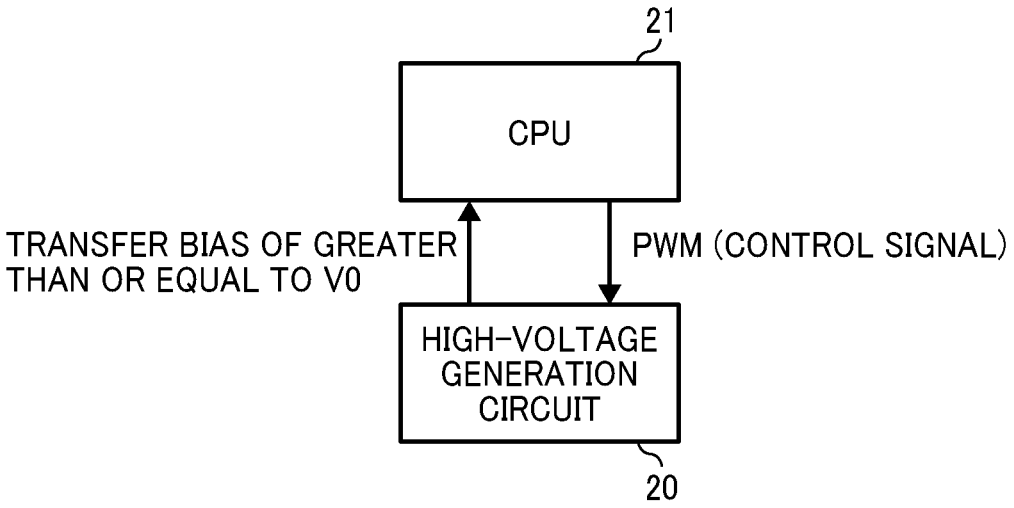
FIG. 6 is a block diagram of a part of the power-source and control system according to the first embodiment illustrated in FIG. 3.
Figure 7:
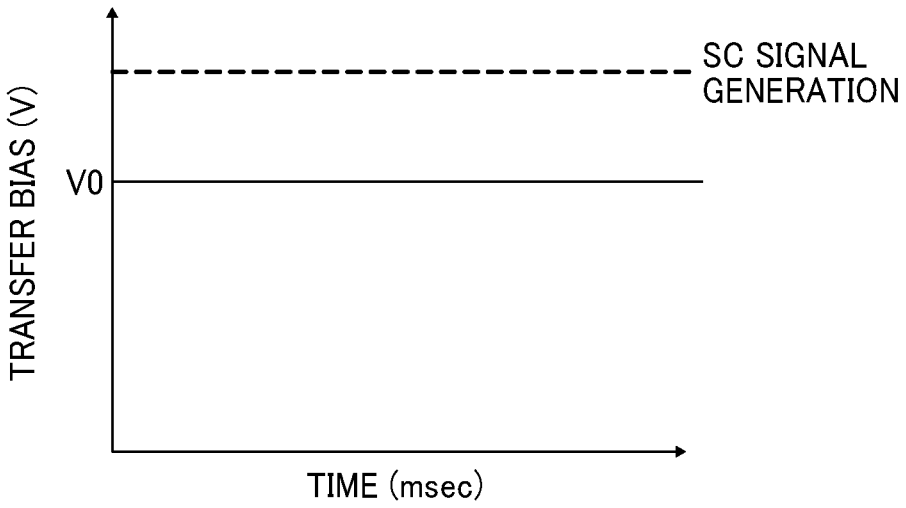
FIG. 7 is a graph for supplementarily describing the power-source and control system of FIG. 6.
Figure 8:
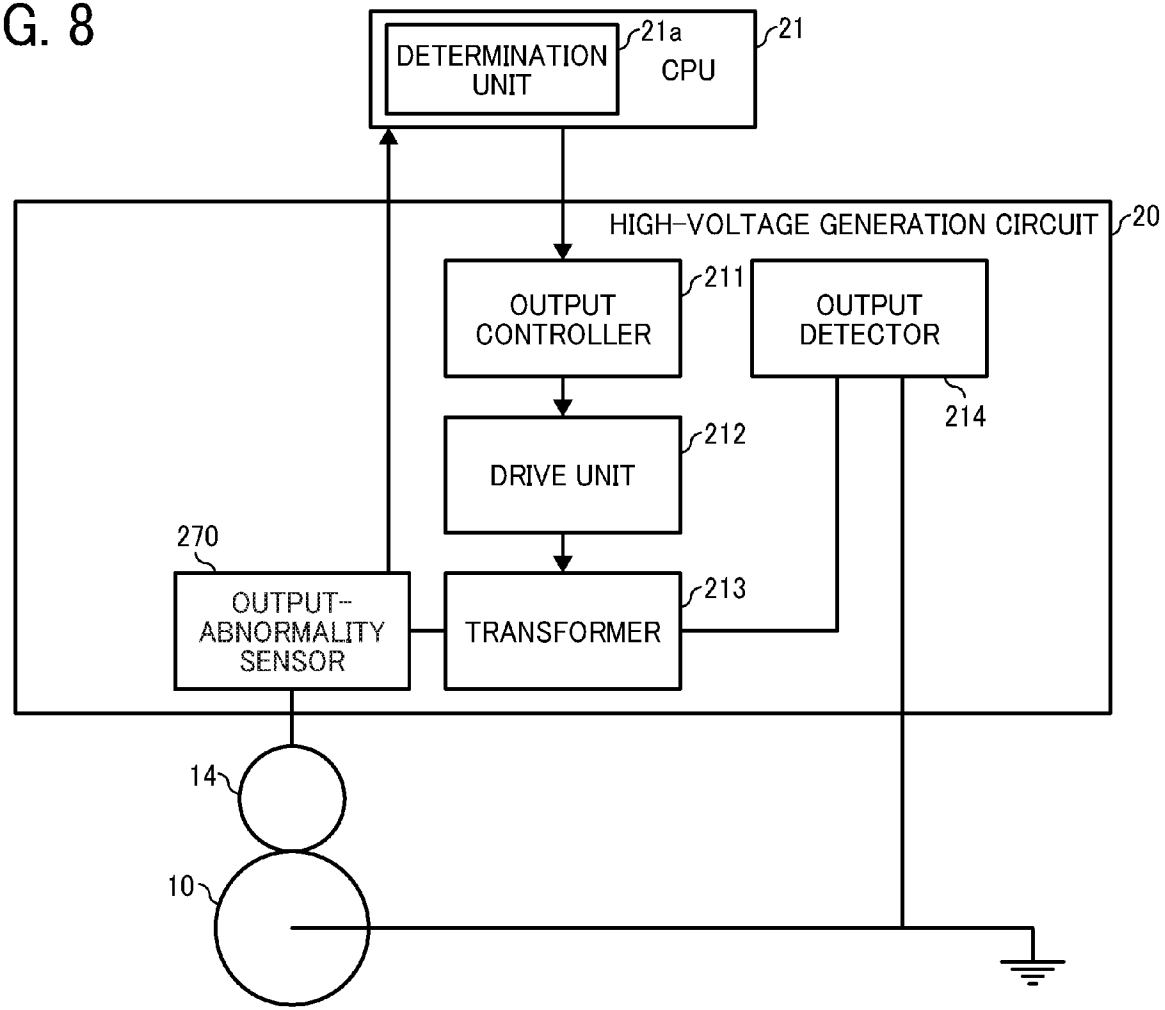
FIG. 8 is a block diagram of an example configuration of a high-voltage generation circuit as a transfer-power source according to the first embodiment.

A detailed description is given below of the configuration of the power-source and control system, referring to FIGS. 6 through 8. FIG. 6 is a block diagram that particularly illustrates a part of the power-source and control system according to the first embodiment in FIG. 3. FIG. 7 is a graph for supplementarily describing the power supply and control system of FIG. 6 in detail. FIG. 8 is a block diagram of an example configuration of the high-voltage generation circuit 20 as a transfer power source that is a voltage application device according to the first embodiment of the present disclosure.

The CPU 21 sends a pulse width modulation (PWM) that is a control signal to the high-voltage generation circuit 20 in image formation as illustrated in FIG. 6. Then, the high-voltage generation circuit 20 outputs current according to the sent PWM signal, to the transfer roller 14 (refer to FIG. 3). Accordingly, a transfer bias that is adjusted to a predetermined current value is applied to the transfer roller 14.

As illustrated in FIG. 8, the image forming apparatus 1 includes the CPU 21 and the high-voltage generation circuit 20. The high-voltage generation circuit 20 that is a toner-transfer power source includes an output controller 211, a drive unit 212, transformer 213, an output detector 214, and an output-abnormality sensor 270.

The CPU 21 outputs the PWM signal (control signal) to the output controller 211 to control the amount of transfer voltage output. The PWM signal (control signal) is determined according to a set value of current. The output detector 214 outputs the output value of the transformer 213 detected by the output detector 214, to the output controller 211. The output controller 211 controls, via the drive unit 212, the drive of the transformer 213 to output a bias value according to the PWM signal, based on a duty ratio of the PWM signal and the output value of the transformer 213 input by the output controller 211.

The output-abnormality sensor 270 of the high-voltage generation circuit 20 determines whether the transfer bias is greater than or equal to the predetermined voltage (V0) at an interval of t1 seconds. With the transfer bias greater than or equal to the predetermined voltage (V0), the output-abnormality sensor 270 sends a SC signal that is a signal to stop the operation of the image forming apparatus 1 and turn on the serviceman's call on the control panel 23, to a determination unit 21*a* of the CPU 21. The determination unit 21*a* determines whether the output-abnormality sensor 270 has detected the transfer bias greater than or equal to the predetermined voltage (V0) a predetermined number of times in succession. When the determination unit 21*a* makes an affirmative determination, The CPU 21 stops the high-voltage generation circuit 20 from outputting high voltage (that is, outputting transfer bias to the transfer roller 14) and stops the operation of the image forming apparatus 1, turning on the serviceman's call on the control panel 23 (refer to step S15 of FIG. 5).

In the first embodiment, the CPU 21 and the high-voltage generation circuit 20 execute the constant current control to maintain a constant transfer ratio of toner. However, in some embodiments, the CPU 21 and the high-voltage generation circuit 20 may execute the constant voltage control. With the constant current control executed, the output controller 211 controls, via the drive unit 212, the drive of the transformer 213 to output a current value according to the PWM signal, i.e., a set current value. With the constant voltage control executed, the output controller 211 controls, via the drive unit 212, the drive of the transformer 213 to output a voltage value according to the PWM signal, i.e., a set voltage value.

The drive unit 212 drives the transformer 213 to output a high direct current (DC) voltage (DC bias) having a positive polarity according to the control of the output controller 211.

The output detector 214 periodically detects an output value of a high DC voltage of the transformer 213 and outputs the detection value to the output controller 211.

The output-abnormality sensor 270, which is disposed on the output line of the high-voltage generation circuit 20 (transfer power source), outputs the SC signal to the CPU 21 when the voltage value becomes greater than or equal to the predetermined voltage V0. With such a configuration allows the CPU 21 to control the high-voltage generation circuit 20 to stop outputting a high voltage.

In the first embodiment, the predetermined voltage V0 is set to 5 kV that is a maximum voltage value (maximum voltage) which the transformer 213 of the high-voltage generation circuit 20 is capable of outputting. Alternatively, in some embodiments, the predetermined voltage V0 is set to 4.8 kV that is slightly less than the maximum voltage value.

The CPU 21 includes the determination unit 21*a*. The determination unit 21*a* determines whether the determination unit 21*a* has received the SC signal from the output-abnormality sensor 270 a predetermined number of times in succession. When the determination unit 21*a* makes an affirmative determination (has detected (received) the SC signal the predetermined number of times in succession), the CPU 21 stops the high-voltage generation circuit 20 from outputting a high voltage (that is, outputting the transfer bias to the transfer roller 14) and stops the operation of the image forming apparatus 1, turning on the serviceman's call on the control panel 23 as described above.

In the first embodiment, the determination unit 21*a* of the CPU 21 and the output-abnormality sensor 270 serve as an abnormality detecting device to detect an abnormal transfer voltage.

In FIG. 8, the CPU 21 controls the high-voltage generation circuit 20 in the following manners (1) and (2). (1) when the detection temperature of the temperature-humidity sensor 22 is greater than or equal to the predetermined temperature and the abnormality detecting device (21*a* and 270) has detected an abnormal voltage (the determination unit 21*a* has detected the SC signal from the output-abnormality sensor 270 the predetermined numbers of time in succession), the CPU 21 controls the high-voltage generation circuit 20 to stop outputting a high voltage (stop applying a transfer voltage to the transfer roller 14); and (2) when the detection temperature of the temperature-humidity sensor 22 is below the predetermined temperature, the CPU 21 controls the high-voltage generation circuit 20 to continue to output a high voltage (apply a transfer voltage) irrespective of whether or not the abnormality detecting device (21*a* and 270) has detected an abnormal voltage (whether the determination unit 21*a* has detected the SC signal from the output-abnormality sensor 270 the predetermined numbers of time in succession). Thus, with a detection temperature of below the predetermined temperature T1, the CPU 21 prohibits the abnormality detecting process of the determination unit 21*a* and the output-abnormality sensor 270.

Such a configuration prevents the generation of an abnormal image due to an abnormal voltage output when a detection temperature is greater than or equal to the predetermined temperature. Further, such a configuration prevents the image forming apparatus 1 from frequently stopping the operation due to the detected abnormal voltage and allows users to continue printing images when a detection temperature is below the predetermined temperature.

Alternatively, in some embodiments, the CPU 21 may stop the determination unit 21*a* from receiving the SC signal (a receiving operation) when the detection temperature of the temperature-humidity sensor 22 is below the predetermined temperature.

According to the first embodiment as described above, the CPU 21 prohibits the detection of output abnormality (abnormal voltage output) of the output-abnormality sensor 270 at low temperatures below the predetermined temperature (for example, below 5° C.), thereby preventing the stop of the operation of the image forming apparatus 1 even with the use of a low-cost high-voltage power source. Thus, this configuration allows users to continue to operate the image forming apparatus, thereby continuing to print images.

[Variation 1]

The low-cost high-voltage power source has a low upper limit (a maximum voltage) of an output voltage. Such a high-voltage power source outputs an abnormal voltage when used without any change. In the first embodiment, masking is used to prevent the abnormal voltage output. In such cases, however, voltage values that are lower than a target voltage value are used for transfer, which may deteriorate image quality. In such cases, users are informed of the possibility of reduction in image quality. When the ambient temperature becomes greater than or equal to the predetermined temperature, such an informative message is retracted. No reduction in image quality appears in images of text while an image failure possibly occurs in halftone images.

Figure 9:
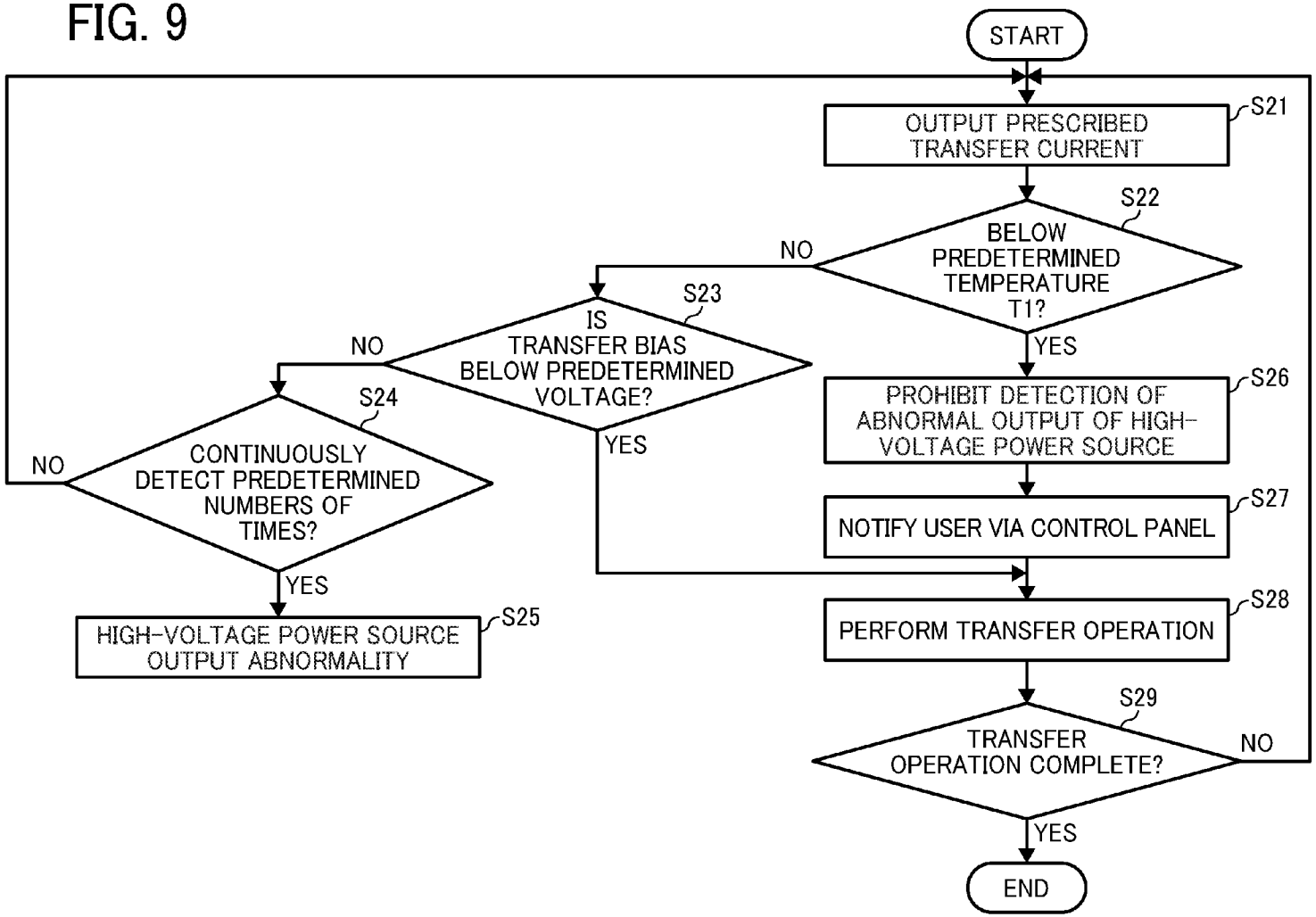
FIG. 9 is a flowchart of an operation sequence according to variation 1 of the first embodiment.

In consideration of the above-described circumstances, a description is given of the variation 1 of the first embodiment, referring to FIG. 9. FIG. 9 is a flowchart of operation sequence according to variation 1 of the first embodiment. The operation sequence according to variation 1 starts from step S21.

The operation sequence of FIG. 9 differs from that of FIG. 5 (the first embodiment) in step S27 for informing a user of a reduction in image quality on the control panel 23, between step S26 (which corresponds to step S16 of FIG. 5) and step S28 (which corresponds to step S17 of FIG. 5).

In other words, when the temperature-humidity sensor 22 detects the temperature below the predetermined temperature T1 (Yes in step S22), the CPU 21 prohibits the voltage detection control and prohibits the detection of an abnormal voltage output (step S26) to prevent the output abnormality of the high-voltage power source in the same manner as in the first embodiment. Subsequently, the operation goes to step S27. The CPU 21 informs a user of a reduction of image quality on the control panel 23 of the image forming apparatus 1. For example, the CPU 21 displays a message "Image quality possibly drops when paper continues to be fed" on the control panel 23. That is, since the voltage lower than a target voltage is applied for transfer as described below, the image quality is likely to deteriorate. The CPU 21 informs a user of the fact of the reduction in image quality before use. Sound may be used for informing users. The same applies to the following embodiments and variations.

[Variation 2]

The image forming apparatus 1 is available at temperatures below the predetermined temperature, but forms poor-quality images. In such unsatisfactory conditions for a user, the CPU 21 asks the user to select whether to wait until the ambient temperature becomes greater than or equal to the predetermined temperature or immediately use without waiting. Specifically, the CPU 21 displays a message according to the ambient temperature on the control panel 23, thereby allowing the user to select a status of use according to the intended used. The CPU 21 informs a user in a hurry of the availability of the image forming apparatus 1. The CPU 21 also informs a user in favor of image quality, of the status of quality before a start of printing.

Figure 10:
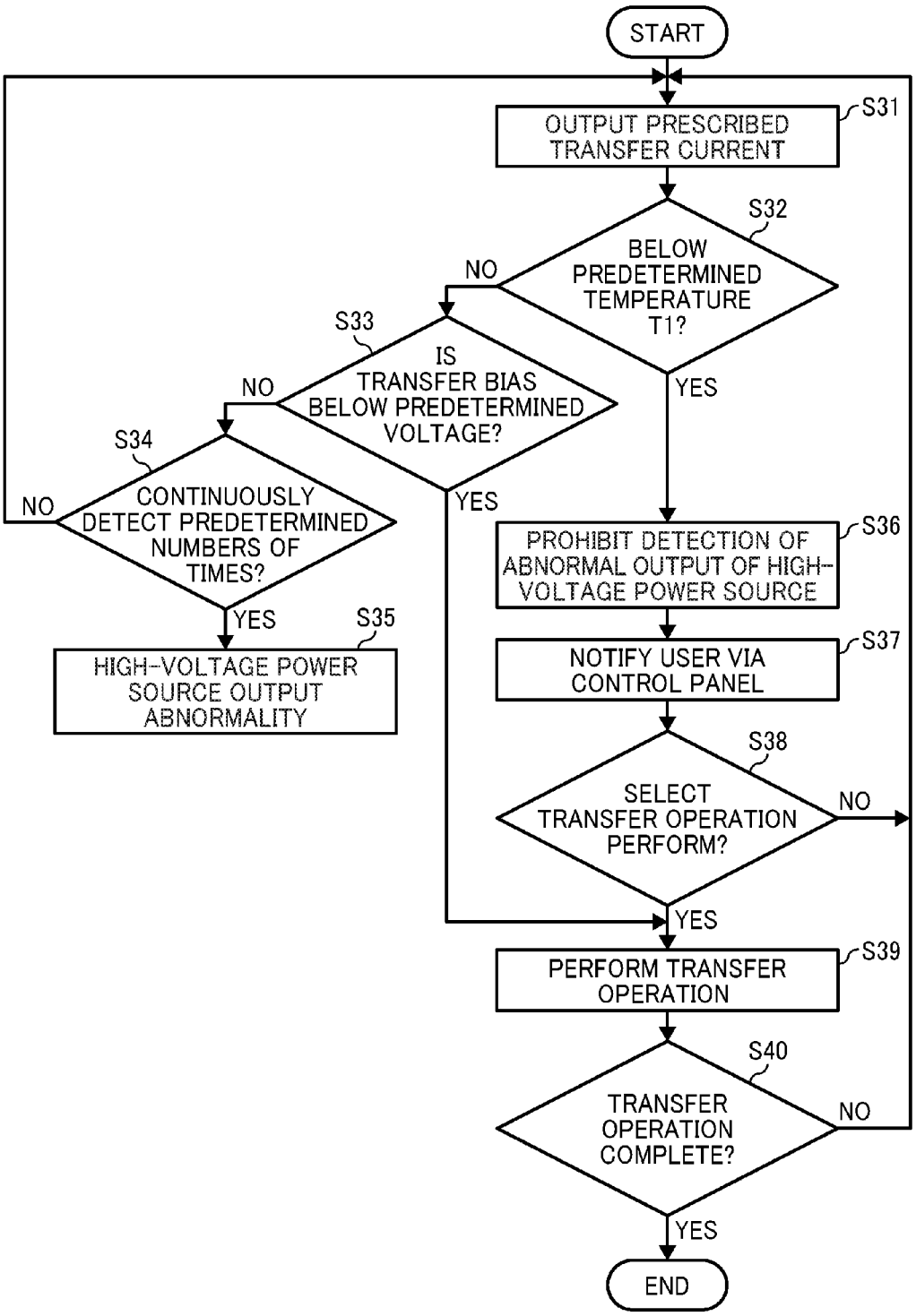
FIG. 10 is a flowchart of an operation sequence according to variation 2 of variation 1.

In consideration of the above-described circumstance, a description is given of variation 2 (a variation of variation 1), referring to FIG. 10. FIG. 10 is a flowchart of an operation sequence according to variation 2. In FIG. 10, the operation sequence starts from step S31.

The operation sequence (variation 2) of FIG. 10 differs from that (variation 1) of FIG. 9 in step S38 for asking whether to execute a print operation (transfer operation) between step S37 (which corresponds to step S27 of FIG. 9) and step S39 (which corresponds to step S28 of FIG. 9). For example, the CPU 21 displays a message "Image quality possibly drops when paper continues to be fed. Select whether to execute printing by pressing a key on the control panel 23", on the control panel 23. Thus, such a configuration allows a user to select whether to continue printing (reprint) or to wait until a stable image quality is obtained (that is, wait until the ambient temperature becomes greater than or equal to the predetermined temperature T1).

In the above-described first embodiment, variations 1 and 2, when the detection temperature of the temperature-humidity sensor 22 is below the predetermined temperature, the CPU 21 prohibits the detection of abnormal output of the high-voltage power source. In such cases, the followings are of concern: When the high-voltage power source is at fault, the transfer roller 14 fails to receive transfer bias, thereby generating an image failure, such as a reduced image concentration, allowing a user to notice the high-voltage power source at fault. In this case, there are no risks of smoke generation and ignition. When the resistance of the transfer roller 14 increases, maintaining a maximum voltage to be applied, the application of a maximum voltage has no influence on the high-voltage power source (this is because the voltage does not exceed the maximum voltage, and a fuse works when abnormalities occur).

As described above, there are no risks of smoke generation and ignition when the detection of abnormal output of the high-voltage power source is prohibited.

In the described-above first embodiment and variations 1 and 2, a description is given of the image forming apparatus 1 with the constant current control of the transfer bias. In some embodiments, the image forming apparatus 1 with the constant voltage control of the transfer bias is also available.

Embodiment 2

In the first embodiment, when the resistance of the transfer roller 14 increases at temperatures below 5° C. and the constant current control is performed, the CPU 21 prohibits the abnormality detection process to prevent the image forming apparatus 1 from stopping operating due to an increase in transfer voltage. However, when an excessive amount of current is applied to the transfer roller 14 at low temperatures below the predetermined temperature, an electrical discharge may occur at and around the transfer portion due to a great potential difference, resulting in the occurrence of abnormalities, such as inverse of the polarity of toner and the distortion of latent images or transferred images.

In order to deal with such a situation, the image forming apparatus 1 according to the second embodiment employs a temperature to detect the ambient temperature to change a current control when the abnormality detection process of the transfer voltage is prohibited in the second embodiment. Thus, even the use of the low-cost high-voltage power source (HVP) prevents or reduces the occurrence of abnormal images.

Figure 11:
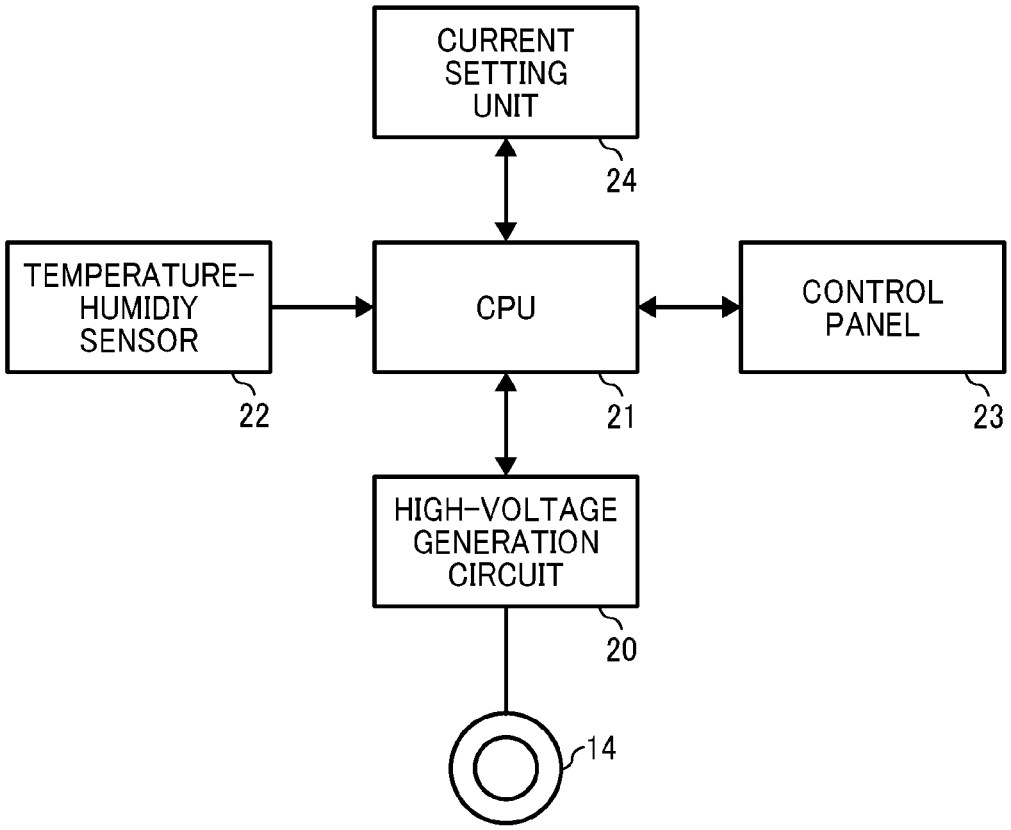
FIG. 11 is a block diagram of an example configuration of a power-source and control system for a transfer roller in the image forming apparatus according to the second embodiment of the present disclosure.

A description is given of a control mechanism according to the second embodiment, referring to FIG. 11. FIG. 11 is a block diagram of an example configuration of a power-source and control system for the transfer roller 14 in the image forming apparatus 1 with a temperature-humidity sensor 22.

The control mechanism of FIG. 11 according to the second embodiment differs from those of the first embodiment as illustrated in FIGS. 3, 6 through 8 in that a current setting unit 24 is electrically connected with the CPU 21 in FIG. 11.

The current setting unit 24 as a setting unit sets a current value as a set current value according to the detection results of the temperature-humidity sensor 22. The current setting unit 24 includes a memory to store the relations of the detected temperature by the temperature-humidity sensor 22 and the set current value. This memory is a nonvolatile memory that stores data regarding the set current values corresponding to the detected temperatures.

The CPU 21 as a control circuit controls the high-voltage generation circuit 20 based on the data regarding the set current values stored and set in the current setting unit 24. The CPU 21 executes the normal control operation as described in FIG. 4. That is, in the same manner as in step S2 through step S4 of FIG. 4, the CPU 21 determines whether the transfer bias is less than a predetermined voltage at an interval of t1 seconds, and also determines whether the transfer bias has been detected the predetermined number of times in succession. When an affirmative determination is made (the transfer voltage has been detected the predetermined numbers of times) in succession, the CPU 21 determines that the high-voltage power source (the high-voltage generation circuit 20) outputs abnormal voltage ("output abnormality of the high-voltage power source") and stops the high-voltage generation circuit 20 from outputting a high voltage. Then, the CPU 21 stops the image forming operation and turns on the serviceman's call on the control panel 23.

Figure 12:
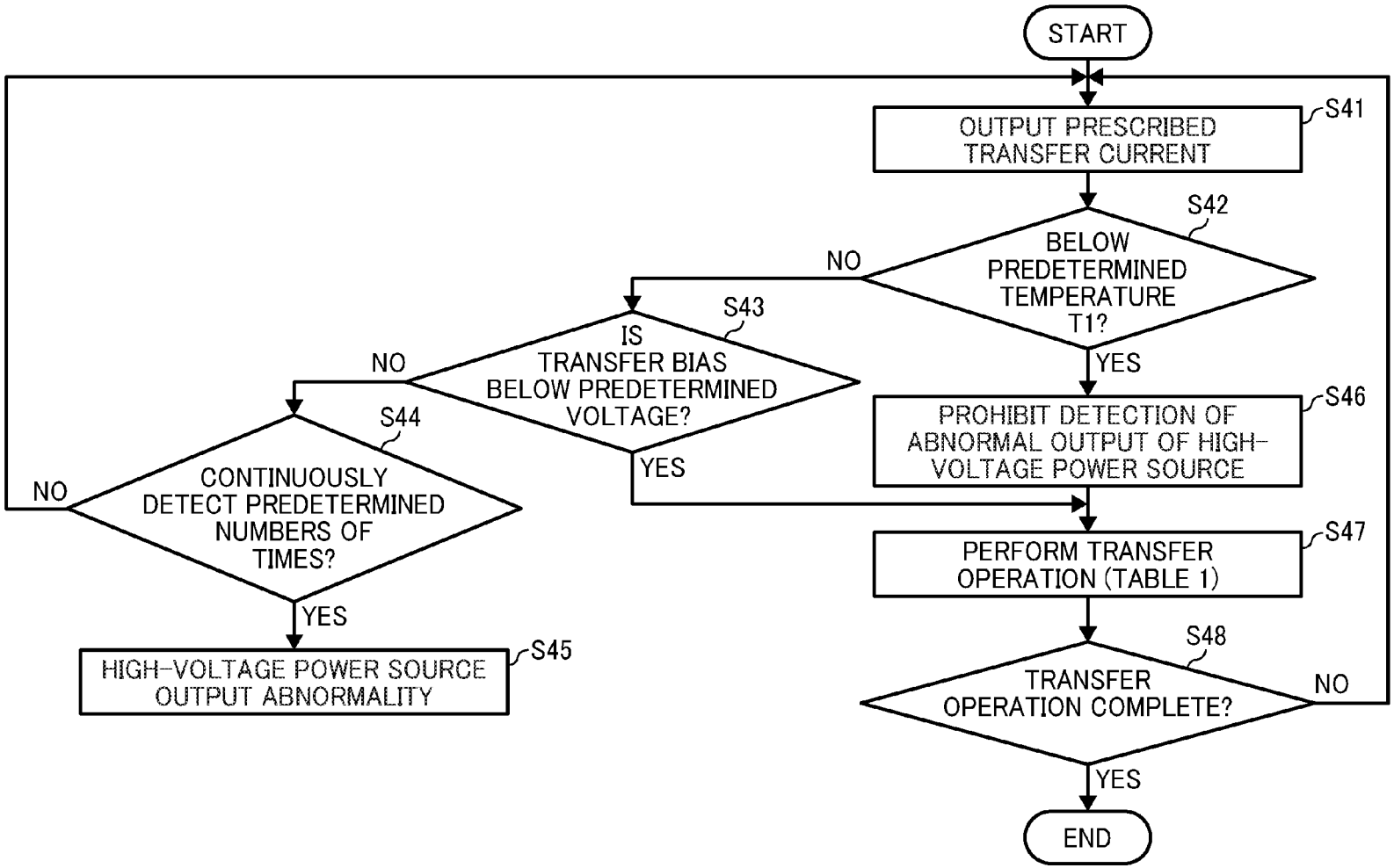
FIG. 12 is a flowchart of an operation sequence according to the second embodiment.

The following describes the differences between the operation sequence according to the second embodiment and the operation sequence according to the first embodiment in FIG. 5, referring to FIG. 12. FIG. 12 is a flowchart of an operation sequence according to the second embodiments.

In the second embodiment as illustrated in FIG. 12, the operation sequence starts from step S41. In the operation sequence according to the second embodiment illustrated in FIG. 12, the CPU 21 prohibits the detection of output abnormality of the high-voltage power source when the detection temperature is below the predetermined temperature T1 (step S46). Then, the CPU 21 executes a transfer current control in accordance with Table 1 to perform a transfer operation in step S47 in prohibiting the detection of an abnormal output of the high-voltage power source. This step S47 is a difference between the operation sequence of FIG. 12 and the operation sequence of FIG. 5.

TABLE 1

| | SET CURRENT (μA) WITH SHEET SIZE A3 | |
|---|---|---|
| TEMPERATURE | FRONT SURFACE | BACK SURFACE |
| 25° C. | 16 | 12 |
| 20° C. | 14 | 11 |
| 15° C. | 12 | 10 |
| BELOW 5° C. | 8 | 8 |
| BELOW 0° C. | 7 | 7 |

When the temperature-humidity sensor 22 detects the temperature below the predetermined temperature T1 (step S46), the CPU prohibits the detection of abnormal output of the high-voltage power source and executes the transfer current control in accordance with Table 1 (step S47). In the transfer current control, the CPU 21 controls the set current value to be lower than that at 15° C. at low temperatures below 5° C. in which image defects attributed to the electrical discharge are likely to occur. The predetermined temperature T1 refers to temperatures below 5° C. Note that the transfer current values are given with a sheet size of A3 in Table 1 and the transfer current value changes with the sheet size.

In particular, the current setting unit 24 checks the detection result of the temperature-humidity sensor 22 with the temperatures and set current values listed in Table 1 to determine a set current value. In FIG. 11, the CPU 21 as a control circuit controls the high-voltage generation circuit 20 based on the set current value of the current setting unit 24. The CPU 21 sends the PWM signal according to the set current value determined by the current setting unit 24 to the high-voltage generation circuit 20, thereby controlling the transfer current output from the high-voltage generation circuit 20 to the transfer roller 14.

A set current value (e.g., 8 μA in Table 1) with the detected temperature of the temperature-humidity sensor 22 below the predetermined temperature (e.g., temperatures below 5° C.) is different from a set current value (e.g., 12 μA in Table 1) with the detected temperature of the temperature-humidity sensor 22 greater than or equal to the predetermined temperature (e.g., temperatures greater than or equal to 15c). Specifically, the former (the set current value for when the detected temperature of the temperature-humidity sensor 22 is below the predetermined temperature) is set lower than the latter (the set current value for when the detected temperature of the temperature-humidity sensor 22).

In step S47 for the transfer current control, the CPU 21 controls the high-voltage generation circuit 20 to output a transfer current with the set current value that is lower than the set current value at 15° C. because the ambient temperature is below 5° C. in which image defects attributed to the electrical discharge are likely to occur.

When the temperature-humidity sensor 22 detects the temperature below the predetermined temperature T1, the CPU 21 prohibits the detection of abnormal output of the high-voltage power source and executes the transfer current control according to each temperature range in Table 1. In such cases, the CPU 21 sets current values for very low temperature ranges, the temperature range of below 5° C. (T1) and the temperature range of below 0° C. (T2), respectively in which image defects attributed to the electrical discharge are likely to occur. The CPU 21 adjusts the transfer current with the set current value according to the temperature range.

The above-described configuration according to the second embodiment improves abnormal images due to an electrical discharge that occurs at and around the transfer portion attributed to a great potential difference. Further, in the configuration according to the second embodiment, the CPU 21 sets the control operation back to the normal control operation when a temperature becomes greater than or equal to the predetermined temperature because the low-cost high-voltage power source (HVP) does not output an abnormal voltage at the temperatures greater than equal to the predetermined temperature in the same manner as in the first embodiment, so as to prevent the occurrence of abnormal images.

Further, the CPU 21 changes a set current value with the temperature within the range of below 5° C., below 0° C., and below the predetermined temperature so that the occurrence of abnormal images is prevented or reduced. With a decrease in the temperature, the resistance of the transfer roller 14 decreases. Accordingly, setting a lower transfer current with a decrease in the temperature increases margin of improvement for abnormal images.

[Variation 3]

In the second embodiment described above, with tan excessive amount of transfer current applied at low ambient temperatures below the predetermined temperature, an electrical discharge occurs at and around the transfer portion due to a great potential difference, resulting in the occurrence of abnormal images, such as inverse of the polarity of toner and the distortion of latent images or transferred images.

In variation 3 of the second embodiment, the CPU 21 controls the toner adhesion adjusting device to reduce a toner adhesion amount at the temperatures below the predetermined temperature to be lower than a toner adhesion amount at the temperatures above the predetermined temperature, in addition to adjusting the transfer current according to the second embodiment described above. Such a configuration increases margin of improvement for the occurrence of abnormal images at the temperatures below the predetermined temperature.

The following describes the adjustment of the toner adhesion amount according to variation 3, referring to FIG. 2.

To adjust the toner adhesion amount, a P sensor 18 is used to detect a test pattern formed by a toner image on a photoconductor 10 with an output power $V_{sp}$ and a background portion that is a portion except the test pattern on the surface of the photoconductor 10 with an output power $V_{sg}$. In this case, the adjustment reference value of a toner concentration sensor 17 is $V_{ref}$ and a detection output power of the toner concentration sensor 17 is $V_t$.

Firstly, with the fixing temperature of the fixing device 7 less than or equal to 100° C. that is detected in turning on the power of the image forming apparatus 1, the P sensor 18 including a reflective-type photosensor is calibrated. In the present variation, the P sensor 18 is activated with a source voltage of 5 V. Further, adjusting the PWM changes the amount of light emission of the P sensor 18 to adjust the detection output power $V_{sg}$ of the P sensor 18 that detects the background portion of the photoconductor 10 to be 4.0 V. Such an adjusted value of the PWM is stored in the non-volatile memory until a subsequent calibration of the P sensor 18.

Subsequently, the following describes a method for forming a test pattern on the photoconductor 10. Driving a main motor that drives the photoconductor 10 and the charging roller 11 forms a latent image potential of a test pattern on the photoconductor 10. In this case, the charging voltage of the charging roller 11 is switched to a predetermined value. Then, the developing device 13 develops an electrostatic latent image of the test pattern into a toner image. Such an image formation process and development process allows a test pattern formation.

The toner adhesion amount of the developed test pattern is detected by the P sensor 18 with a detection output power $V_{sp}$.

To detect an accurate value of output power $T_{sg}$, the P sensor 18 detects a background portion to which almost no toner adherers on the photoconductor 10 that has passed through the developing device 13 which is not operating. The CPU 21 determines the adjustment reference value $V_{ref}$ of the toner concentration sensor 17 according to the ratio of $V_{sp}$ to $V_{sg}$ with the process to be described later. The toner concentration sensor 17 continuously detects the toner concentration within the developing device 13 during the operation of the developing device 13. The CPU 21 calculates the difference between the sensor output Vt and the adjustment reference value $V_{ref}$ of the toner concentration sensor 17 to determine the amount of toner supplied to the developing device 13 according to the difference. As a result, supplying the determined amount of toner to the developing device 13 adjusts the image density.

The output power $V_{sp}$ that refers to the amount of light reflected from a test pattern increases with a decrease in toner concentration within the developer, i.e., little toner in the test pattern. In this example, when $V_{sg}$ is 4.0 V, $V_{sp}$ is 0.4 V. That is, the reference value $V_{ref}$ of adjustment is $V_{sp}/V_{sg}=1/10$. The CPU 21 determines that the toner concentration decreases with an increase in $V_{sp}/V_{sg}$. In such cases, the CPU 21 changes $V_{ref}$ to increase the toner concentration. The change in the value of $V_{ref}$ allows adjusting an image density to change the amount of toner adhesion.

In variation 3, the CPU 21, the developing device 13, and the P sensor 18 constitutes a toner adhesion adjusting device to adjust the amount of toner adhering to the photoconductor 10.

Figure 13:
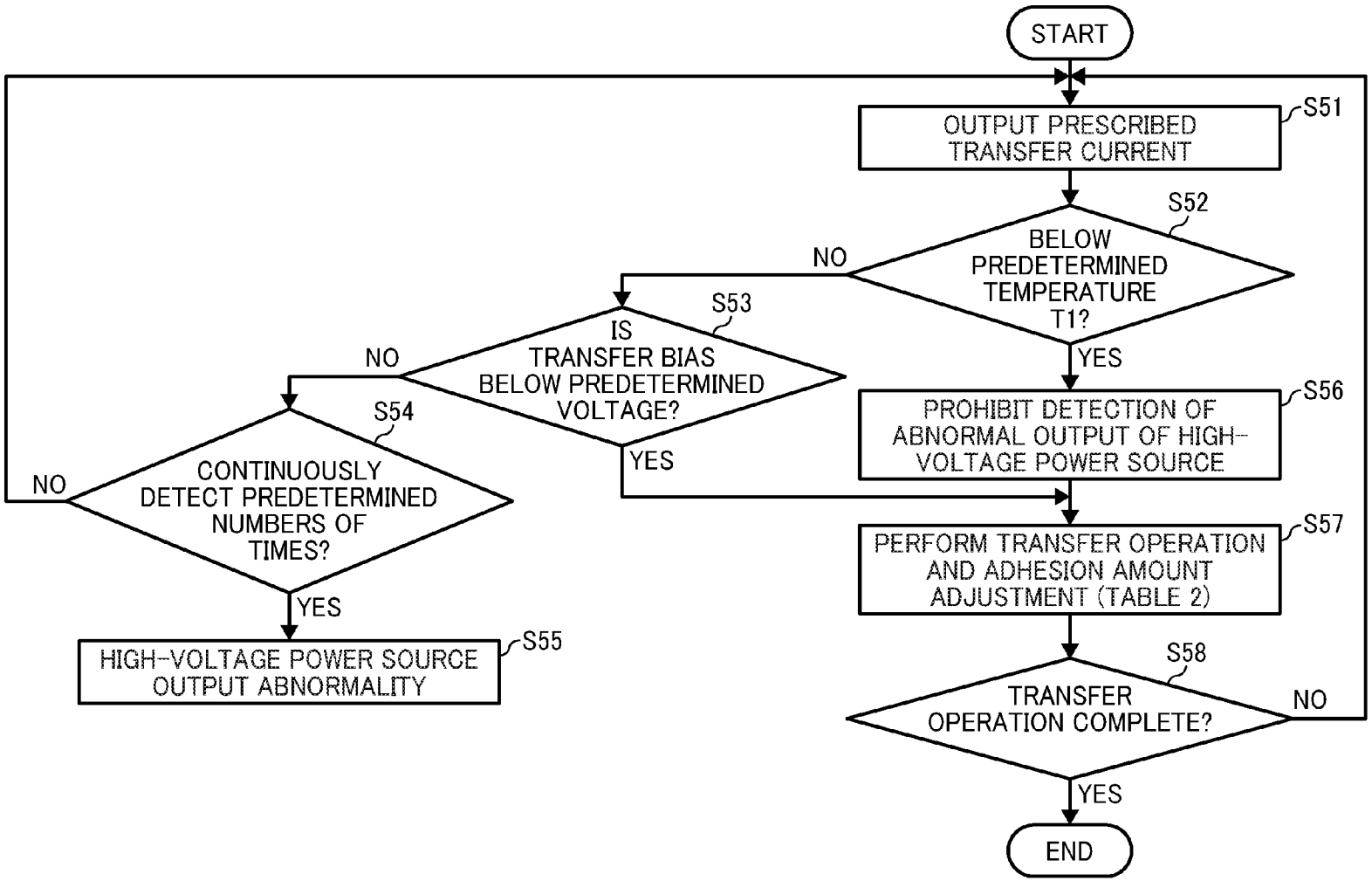
FIG. 13 is a flowchart of an operation sequence according to variation 3 of the second embodiment.

The following describes the differences between the operation sequence according to variation 3 and the operation sequence according to the second embodiment in FIG. 12, referring to FIG. 13. FIG. 13 is a flowchart of an operation sequence according to variation 3.

The operation sequence according to variation 13 starts from step S51 in FIG. 13. In the operation sequence according to variation 3 illustrated in FIG. 13, the CPU 21 prohibits the detection of output abnormality of the high-voltage power source when the detection temperature is below the predetermined temperature T1 (step S56). Then, the CPU 21 executes an operation peculiar to step S57. The operation sequence according to variation 3 in FIG. 13 differs in step S57 from the operation sequence of FIG. 12. In step S57, the CPU 21 executes a transfer operation and adjusts the amount of toner adhesion in accordance with Table 2.

TABLE 2

| TEMPERATURE | SET CURRENT (μA) WITH SHEET SIZE A3 FRONT SURFACE | BACK SURFACE | REDUCTION RATE OF TONER ADHESION — |
|---|---|---|---|
| 25° C. | 16 | 12 | — |
| 20° C. | 14 | 11 | — |
| 15° C. | 12 | 10 | — |
| BELOW 5° C. | 8 | 8 | 3% |
| BELOW 0° C. | 7 | 7 | 5% |

When the temperature-humidity sensor 22 detects the temperature below the predetermined temperature T1 (step S52), the CPU prohibits the detection of abnormal output of the high-voltage power source and executes the transfer current control in accordance with Table 2 (step S57). In the transfer current control, the CPU 21 controls the set current value to be lower than that at 15° C. at low temperatures below 5° C. in which image defects attributed to the electrical discharge are likely to occur. In this case, the CPU 21 also reduces (adjusts) toner adhesion (a toner adhesion amount) at the same time.

Figure 14:
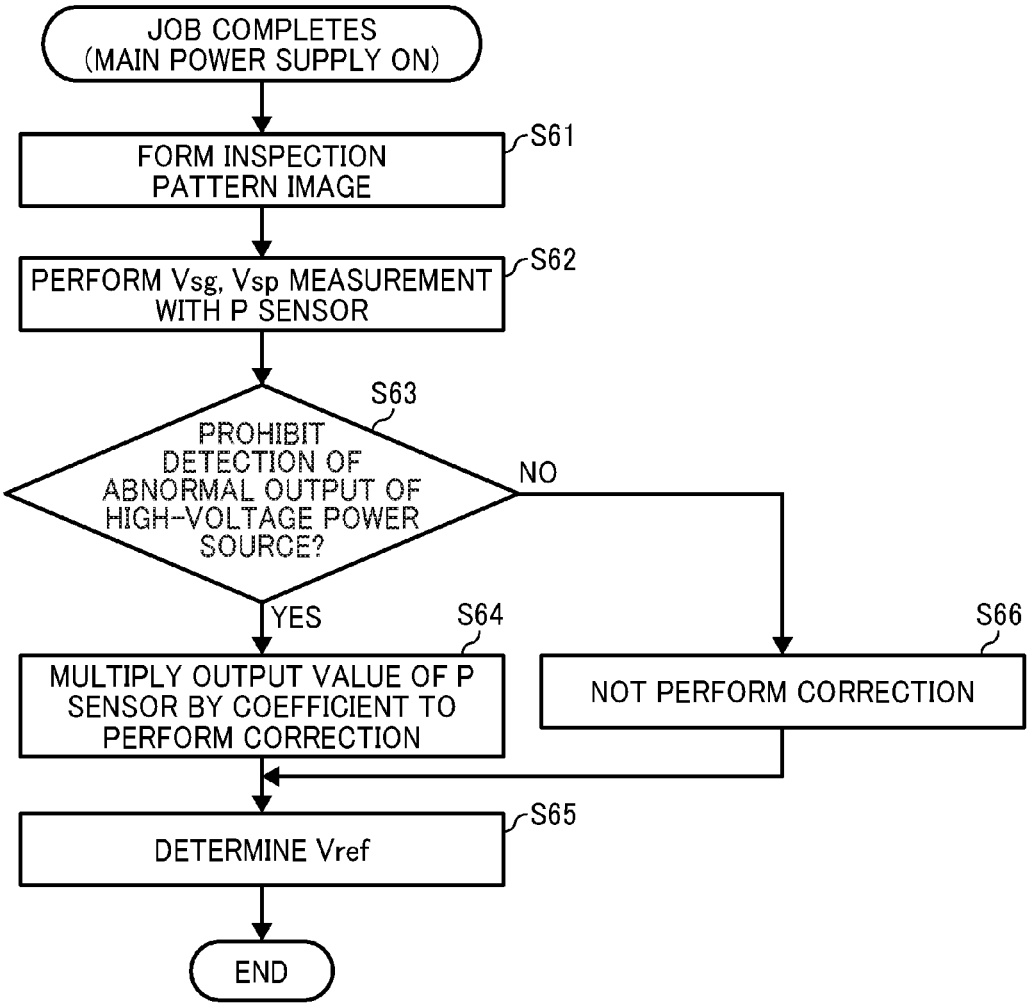
FIG. 14 is a flowchart of an operation sequence for adjusting toner adhesion according to variation 3 of the second embodiment.

The following describes the adjustment (reduction) of toner adhesion in accordance with Table 2, referring to FIG. 14. FIG. 14 is a flowchart of an operation sequence for adjusting toner adhesion according to variation 3.

As illustrated in FIG. 14, after the image forming apparatus 1 is turned on, the CPU 21 forms a test pattern on the photoconductor 10 (step S61). Subsequently, the P sensor 18 measures an output power $V_{sg}$ of a background portion except a test pattern on the surface of the photoconductor 10 and an output power $V_{sp}$ of the test pattern (in step S62). In step S63, the CPU 21 determines whether to prohibit the detection of an abnormal output of the high-voltage power source as described in step S56 of FIG. 13. When making an affirmative determination, the CPU 21 multiplies the measured output power $V_{sp}$ of the P sensor 18 by a coefficient to reduce toner adhesion, i.e., making a correction (step S64). Accordingly, the CPU 21 determines that the toner concentration increases with a decrease in the value of $V_{sp}/V_{sg}$. The CPU 21 thereby increases the adjustment reference value $V_{ref}$ to reduce the toner concentration, thus reducing toner adhesion. In this case, the value $V_{ref}$ is adjusted by multiplying the value $V_{sp}$ by a coefficient α ($V_{sp}\times\alpha$) to increase so that the toner adhesion decreases by 3% at temperatures below 5° C. as indicated in Table 2.

The CPU 21 adjusts the transfer current with the respective set current values for the temperature range of below 5° C. and the temperature range of below 0° C. because image defects attributed to the electrical discharge are likely to occur at such very low temperatures below 5° C. and below 0° C. Increasing the output power $V_{sp}$ of the test pattern reduces a toner adhesion amount. Accordingly, the CPU 21 determines that the toner concentration increases with a decrease in the value of $V_{sp}/V_{sg}$. The CPU 21 increases the adjustment reference value $V_{ref}$ to reduce the toner concentration, thus reducing a toner adhesion amount. In this case, the value $V_{ref}$ is adjusted by multiplying the value $V_{sp}$ by a coefficient α ($V_{sp}\times\alpha$) to increase so that the toner adhesion decreases by 3% at temperatures below 5° C. Alternatively, the value $V_{ref}$ is adjusted by multiplying the value $V_{sp}$ by a coefficient β ($\beta\times V_{sp}$) to increase so that the toner adhesion further decreases at temperatures below 0° C.

In variation 3 as described above, the CPU 21 as a control circuit controls the toner adhesion adjusting device to reduce the toner adhesion amount at the detection temperature of the temperature-humidity sensor 22 of below the predetermined temperature to be lower than the toner adhesion amount at the detection temperature of greater than or equal to the predetermined temperature. Further, the CPU 21 as a control circuit controls the toner adhesion amount adjusting device to change the toner adhesion amount at the detection temperature of below the predetermined temperature with the detection temperature. Further, the CPU 21 as a control circuit controls the toner adhesion amount adjusting device to reduce the toner adhesion amount at the detection temperature of below the predetermined temperature, with a decrease in detection temperature.

The above-described configuration according to variation 3 reduces a toner adhesion amount, thereby preventing or reducing the occurrence of abnormal images due to an electrical discharge generated at and around the transfer portion attributed to a great potential difference at low temperatures below the first predetermined temperature T1 (for example, below 5° C.). With a decrease in the temperature, the resistance of the transfer roller 14 decreases. Thus, setting a lower transfer current further prevents or reduces the occurrence of abnormal images.

[Variation 4]

Figure 15:
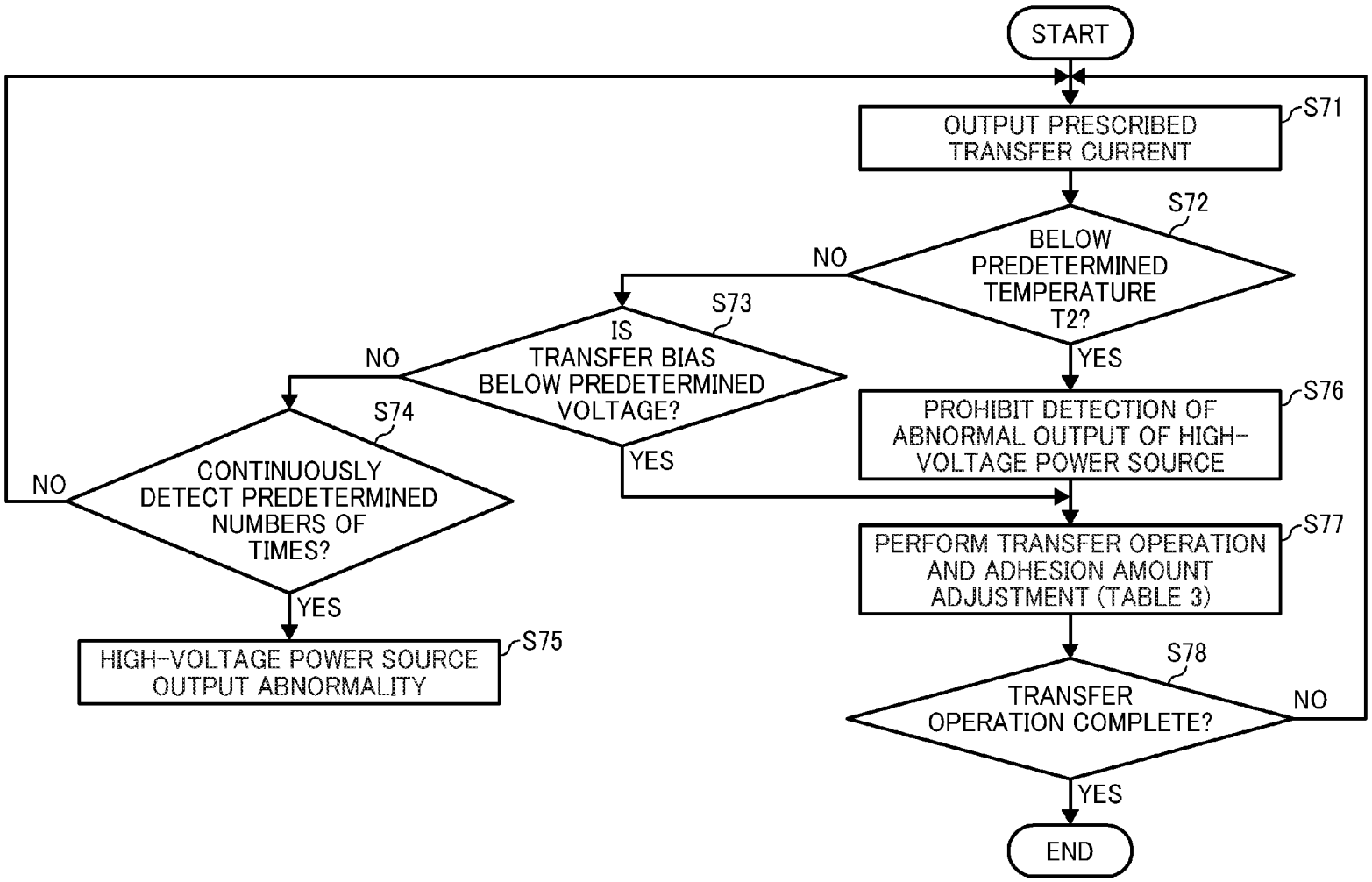
FIG. 15 is a flowchart of an operation sequence according to variation 4 of variation 3.

A description is given of variation 4 (a variation of variation 3), referring to FIG. 15. FIG. 15 is a flowchart of an operation sequence according to variation 4.

The operation sequence according to variation 4 starts from step S71 in FIG. 15. The operation sequence according to variation 4 illustrated in FIG. 15 differs from the operation sequence of FIG. 13 in step S77 of FIG. 15. In step S77, the CPU 21 executes a transfer operation and controls the toner adhesion adjusting device to reduce a toner adhesion amount when the detection temperature of the temperature-humidity sensor 22 is below a second predetermined temperature T2 that is lower than the first predetermined temperature T1. In step S77, the CPU 21 executes a transfer operation and control the toner adhesion adjusting device to adjust the amount of toner adhesion in accordance with Table 3.

TABLE 3

| TEMPERATURE | SET CURRENT (μA) WITH SHEET SIZE A3 FRONT SURFACE | BACK SURFACE | REDUCTION RATE OF TONER ADHESION — |
|---|---|---|---|
| 25° C. | 16 | 12 | — |
| 20° C. | 14 | 11 | — |
| 15° C. | 12 | 10 | — |
| BELOW 5° C. | 8 | 8 | — |
| BELOW 0° C. | 7 | 7 | 5% |

As illustrated in FIG. 15, when prohibiting the detection of abnormal output of the high-voltage power source at temperatures below the predetermined temperature T2 in step S76, the CPU 21 increases the adjustment reference value $V_{ref}$ of the toner concentration sensor 17 to reduce a toner adhesion amount. In this case, the CPU 21 increases the value $V_{ref}$ by multiplying the value $V_{sp}$ by a coefficient β ($\beta\times V_{sp}$) to reduce a toner adhesion amount at the temperatures T2 below 0° C., as indicated in Table 3. This is because image defects attributed to the electrical discharge are likely to occur at such very low temperatures T2 below 0° C.

In variation 4 as described above, the CPU 21 as a control circuit controls the toner adhesion adjusting device to reduce the toner adhesion amount at the detection temperature of the temperature-humidity sensor 22 of below the second predetermined temperature T2 that is lower than the first predetermined temperature T1 to be lower than the toner adhesion amount at the detection temperature of greater than or equal to the first predetermined temperature T1.

The above-described configuration according to variation 4 reduces a toner adhesion amount, thereby preventing or reducing the occurrence of abnormal images due to an electrical discharge generated at and around the transfer portion attributed to a great potential difference at low temperatures below the second predetermined temperature T2 (for example, below 0° C.). With a decrease in the temperature, the resistance of the transfer roller 14 decreases. Thus, setting a lower transfer current further prevents or reduces the occurrence of abnormal images.

In the described-above second embodiment, a description is given of the image forming apparatus 1 with the constant current control of the transfer bias. In some embodiments, the image forming apparatus 1 with the constant voltage control of the transfer bias is also available.

When the transfer bias is under the constant voltage control, the CPU 21 as a control circuit controls a voltage application device to output a voltage with set voltage value. The setting unit sets a set voltage value according to the detection results of the temperature-humidity sensor 22 as a temperature sensor.

A set voltage value with the detection temperature of the temperature-humidity sensor 22 below the predetermined temperature is different from a set voltage value when the detection temperature is greater than or equal to the predetermined temperature. Specifically, a set voltage value with the detection temperature of the temperature-humidity sensor 22 below the predetermined temperature is lower than a set voltage value when the detection temperature is greater than or equal to the predetermined temperature. Such a configuration also prevents or reduces the occurrence of abnormal images due to an electrical discharge that occurs at and around the transfer portion.

Third Embodiment

The resistance of the transfer roller 14 tends to increase over time. In such cases, the resistance of the transfer roller 14 is more likely to increase at low temperatures. Accordingly, a threshold value that is set at a predetermined temperature to prohibit an abnormality detection process is expected to vary over time.

In order to deal with such a situation, the configuration according to the third embodiment prevents the image forming apparatus 1 from stopping operating due to an abnormal output of the high-voltage power source even with changes in resistance of the transfer roller 14.

Figure 16:
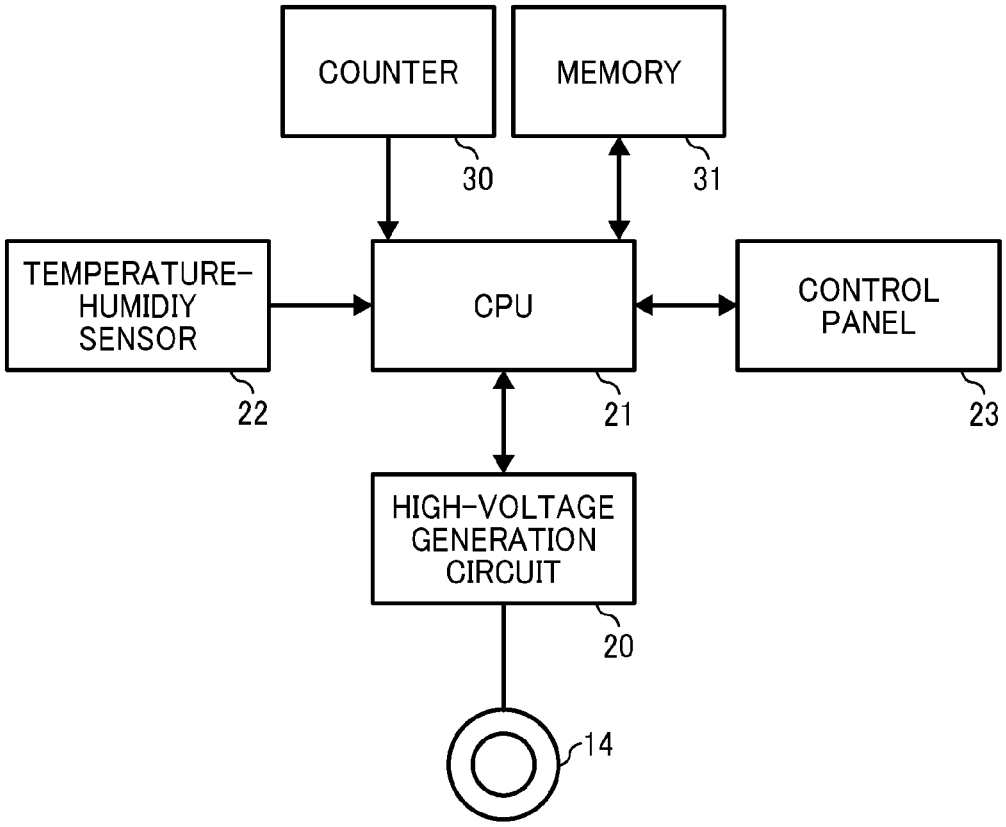
FIG. 16 is a block diagram of an example configuration of a power-source and control system for a transfer roller in the image forming apparatus according to the third embodiment of the present disclosure.

A description is given of a control mechanism according to the third embodiment, referring to FIG. 16. FIG. 16 is a block diagram of an example configuration of a power-source and control system for the transfer roller 14 in the image forming apparatus 1 with a temperature-humidity sensor 22.

The control mechanism of FIG. 16 according to the third embodiment differs from those of the first embodiment as illustrated in FIG. 3 in that the image forming apparatus 1 includes a counter 30 and a memory 31 in the third embodiment. The counter 30 stores elapsed time data, such as the travel distance of the transfer roller 14 as a transfer device, the number of sheets fed for printing (the number of sheet recording media fed to a transfer nip), or the driving time of the transfer roller 14. The memory 31 is a nonvolatile memory that stores a data table of the relations of predetermined temperatures and the elapsed time data as indicated in Table 4 to be described later.

When the resistance of the transfer roller 14 increases over time, a high-voltage power source outputs an abnormal voltage at a predetermined temperature Tn (n=1 at an initial stage) that has been set at first because the resistance of the transfer roller 14 further increases at low temperatures. In order to deal with such circumstances, the CPU 21 according to the third embodiment changes a predetermined temperature based on the elapsed time data (the number of sheets fed for printing, for example) stored in the counter 30 in accordance with data stored in the memory 31.

Figure 17:
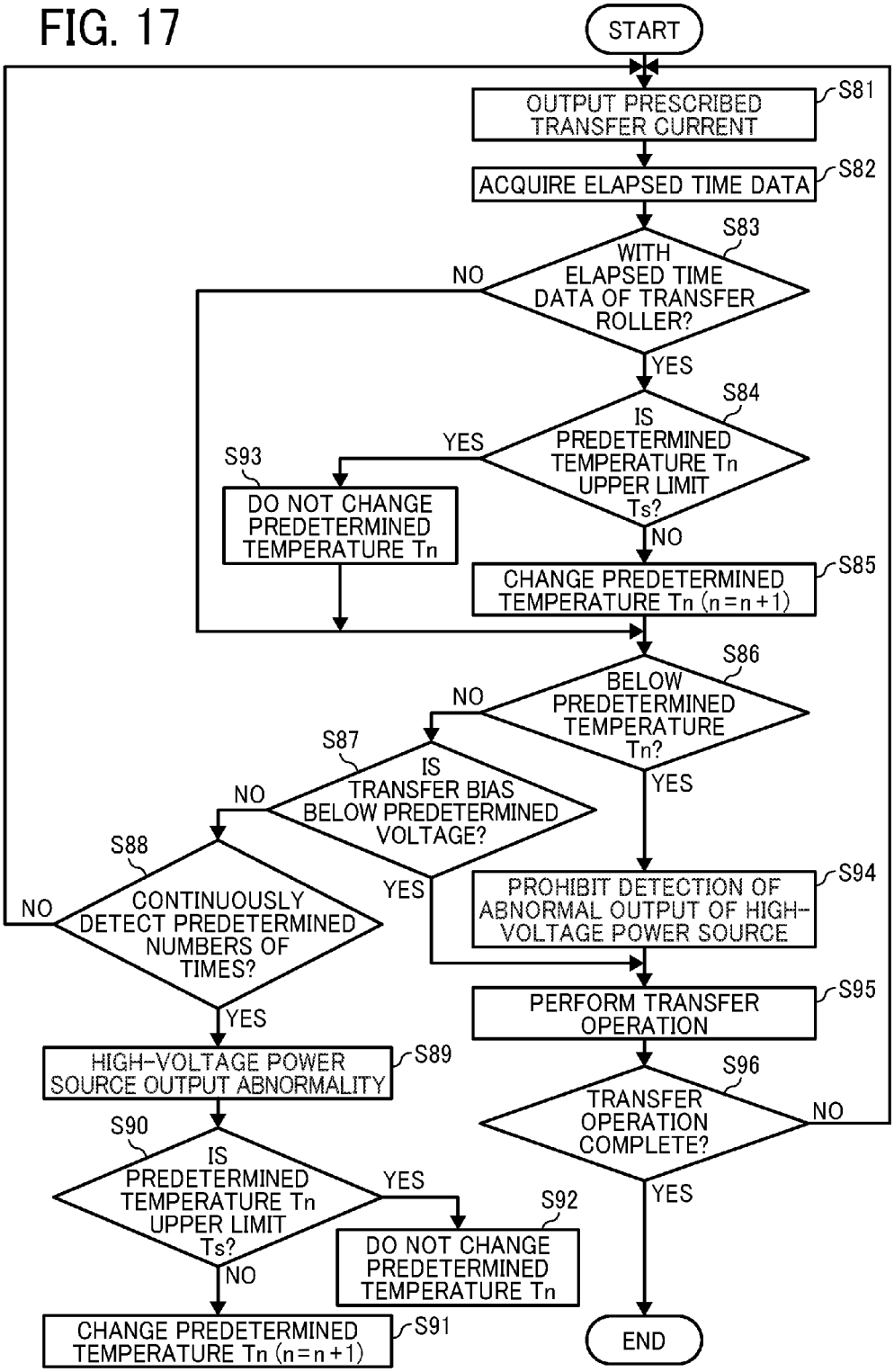
FIG. 17 is a flowchart of an operation sequence according to the third embodiment.

The following describes an operation sequence according to the third embodiment, referring to FIG. 17. FIG. 17 is a flowchart of the operation sequence according to the third embodiments. The operation sequence of FIG. 17 starts from step S81. In step S81, the high-voltage generation circuit 20 outputs a prescribed transfer current to the transfer roller 14 at the predetermined temperature T1 (in this case). Subsequently, the CPU 21 acquires current elapsed time data (the number of sheets fed for printing) from the counter 30 and changes the predetermined temperature T1 into a second predetermined temperature T2 by adding one to one (n=n+1) when the number of sheets fed exceeds one hundred thousand in accordance with Table 4 of the memory 31.

TABLE 4

| PREDETERMINED TEMPERATURE (° C.) | ELAPSED TIME DATA (SHEET NUMBER/A4Y) |
|---|---|
| T1 | — |
| T2 | 100000 |
| T3 | 120000 |
| T4 | 140000 |

In the same manner as described above, the CPU 21 further changes the second predetermined temperature T2 into a third predetermined temperature T3 by adding one to two (n=n+1) when the number of sheet fed exceeds one hundred and twenty thousand. The CPU 21 changes the third predetermined temperature T3 into a fourth predetermined temperature T4 by adding one to three (n=n+1) when the number of sheet fed exceeds one hundred forty thousand.

In the third embodiment, the upper limit Ts is set for a predetermined temperature, as a fourth predetermined temperature T4. That is, CPU 21 repeatedly changes a predetermined temperature Tn until the predetermined temperature Tn becomes the fourth predetermined temperature T4 that is the upper limit Ts (step S82 through step S85). In step S84, when the predetermined temperature Tn is the upper limit Ts, the CPU 21 prohibits the change in predetermined temperature Tn.

With a type of sheet that contains a high level of calcium carbonate, the resistance of the transfer roller 14 easily increases. In the image forming apparatus that frequently employs such a type of sheet for printing, the second predetermined temperature T2 is preferably set even with one hundred-thousand sheets or less. Assuming such cases, the CPU 21 changes the predetermined temperature Tn by adding one to n (n=n+1) even when the high-voltage power source outputs an abnormal voltage at temperatures above the predetermined temperature Tn (step S89). In such a case as well, the CPU 21 changes the predetermined temperature Tn unless the predetermined temperature Tn is the upper limit Ts (step S91). Alternatively, the CPU 21 prohibits the change in predetermined temperature Tn when the predetermined temperature Tn is the upper limit Ts (step S92). As examples of the predetermined temperature Tn, the predetermined temperature T1 is 5° C., the second predetermined temperature T2 is 6° C., the third predetermined temperature T3 is 7° C., and the fourth predetermined temperature T4 is 8° C.

In the third embodiment, the elapsed time data employed in step S83, which is the number of sheets fed for printing, is stored in the counter 30. However, the elapsed time data employed is not limited to the number of sheets fed for printing and may be the travel distance of the transfer roller 14 for one hundred-thousand sheets, e.g., having A4 size, in a transverse direction or may be the driving time of the transfer roller 14. In some embodiments, the CPU 21 may acquire elapsed time data, using a conversion formula according to a sheet size, such as A3 size, or a print mode, such as double-sided printing.

As described above, the CPU 21 according to the third embodiment changes a predetermined temperature Tn according to elapsed time data, such as the travel distance of the transfer roller 14, the number of sheets fed for printing, or the driving time of the transfer roller 14.

With the configuration according to the third embodiment that changes a predetermined temperature Tn (a few times) with elapsed time data, the high-voltage power source is prevented from outputting an abnormal voltage at low temperatures.

The CPU 21 according to the third embodiment changes a predetermined temperature Tn when the abnormality detecting device (21*a* and 270) detects the abnormal output at temperatures above the predetermined temperature having changed.

Such a configuration prevents the high-voltage power source from outputting an abnormal voltage at low temperatures without stopping the operation of the image forming apparatus 1 even when the resistance of the transfer roller 14 unexpectedly increases.

The CPU 21 according to the third embodiment changes a predetermined temperature Tn so that the changed predetermined temperature T(n+1) is greater than the predetermined temperature Tn before the change.

Such a configuration prevents the high-voltage power source from outputting an abnormal voltage at low temperatures without stopping the operation of the image forming apparatus 1 even when the resistance of the transfer roller 14 increases over time.

The CPU 21 according to the third embodiment prohibits a change in predetermined temperature when a changed predetermined temperature is the upper limit Ts that is set for a predetermined temperature to be changed.

Such a configuration in which the upper limit is set for a predetermined value prevents the prohibition of the abnormality detection process at the ambient temperature other than the low temperatures due to an increase in predetermined temperature with changes in predetermined temperature.

[Variation 5]

In variation 5 of the third embodiment, the CPU 21 changes a predetermined temperature Tn (n=1) when the high-voltage power source outputs an abnormal voltage, thereby preventing the high-voltage power source from outputting an abnormal voltage over time.

Figure 18:
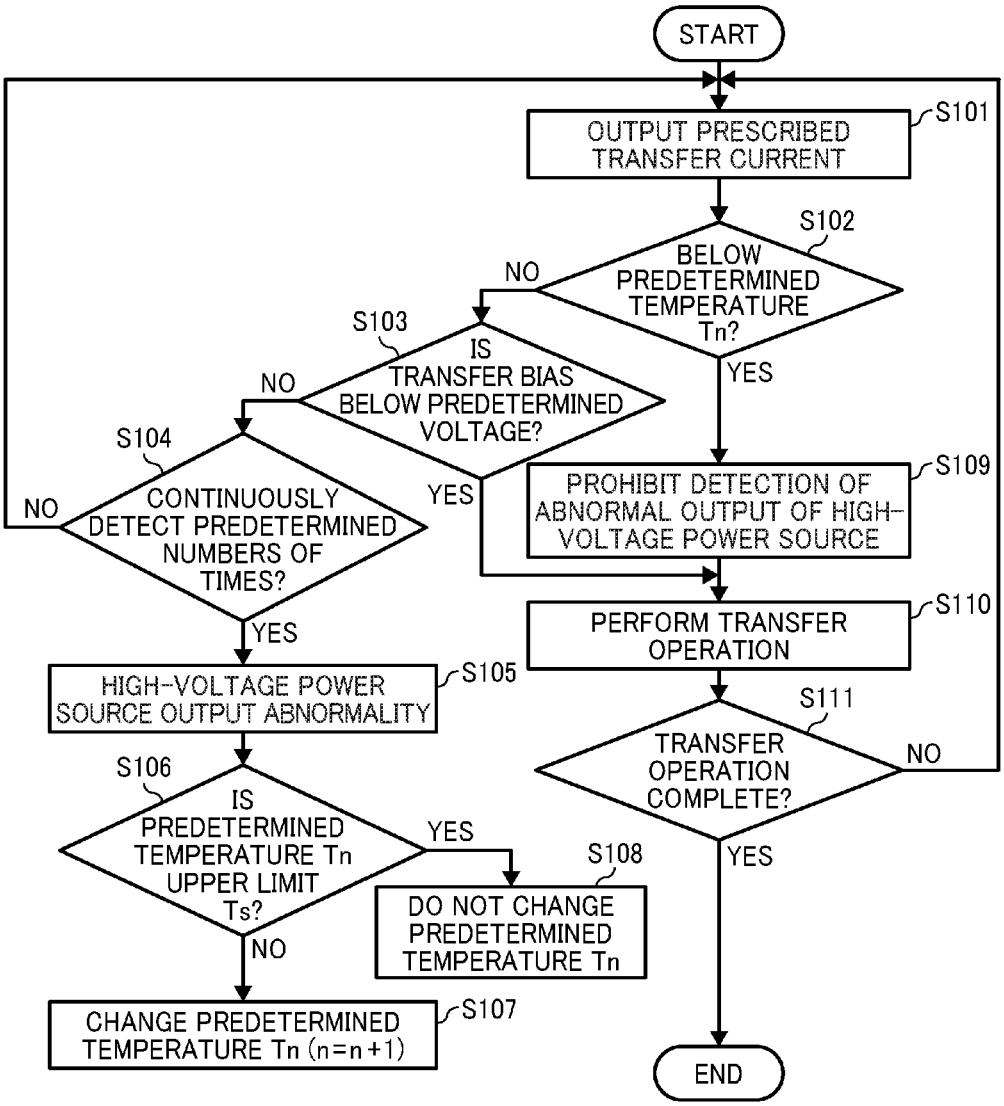
FIG. 18 is a flowchart of an operation sequence according to variation 5 of the third embodiment.

A description is given of variation 5 of the third embodiment, referring to FIG. 18. FIG. 18 is a flowchart of an operation sequence according to variation 5. The operation sequence of FIG. 18 starts from step S101. The operation sequence according to variation 5 in FIG. 18 differs from the operation sequence according to the third embodiment in FIG. 17 in step S82 through step S85 and step S93 of FIG. 17 (elapsed time data of the transfer roller 14 is counted) and in that the CPU 21 changes a predetermined temperature Tn without using Table 4 when the abnormality detecting device (21*a* and 270) detects abnormal output at temperatures above the predetermined temperature Tn.

In step S105 of FIG. 18, the CPU 21 changes the predetermined temperature Tn unless the predetermined temperature Tn is the upper limit Ts (step S107). Alternatively, the CPU 21 prohibits the change in predetermined temperature Tn when the predetermined temperature Tn is the upper limit Ts (step S108). In variation 5 as described above, no elapsed time data of the transfer roller 14 is counted and stored in the counter 30, and no data of Table 4 is employed.

As described above, the CPU 21 as a control circuit according to variation 5 in FIG. 18 changes a predetermined temperature Tn when the abnormality detecting device (21*a* and 270) detects the abnormal output at the detection temperature of the temperature-humidity sensor 22 above the predetermined temperature Tn.

In the third embodiment described above, when the resistance of the transfer roller 14 increases over time, the resistance of the transfer roller 14 further increases at low temperatures, and the transfer voltage thereby increases to a value of greater than or equal to a set value even at a predetermined temperature Tn that has been set at first, which may turn on the serviceman's call.

However, with the configuration according to variation 5 that changes a predetermined temperature Tn (a few times) when a high-voltage abnormality occurs, the high-voltage power source is prevented from outputting an abnormal output at low temperatures without stopping the operation of the image forming apparatus employed.

[Variation 6]

In variation 6, the CPU 21 determines the possibility of abnormal output of the high-voltage power source when the predetermined temperature is continuously changed the predetermined number of times or more in the above-described third embodiment and variation 5, to stop the operation of the image forming apparatus 1 in consideration of safety in case that output abnormalities really occur.

Figure 19:
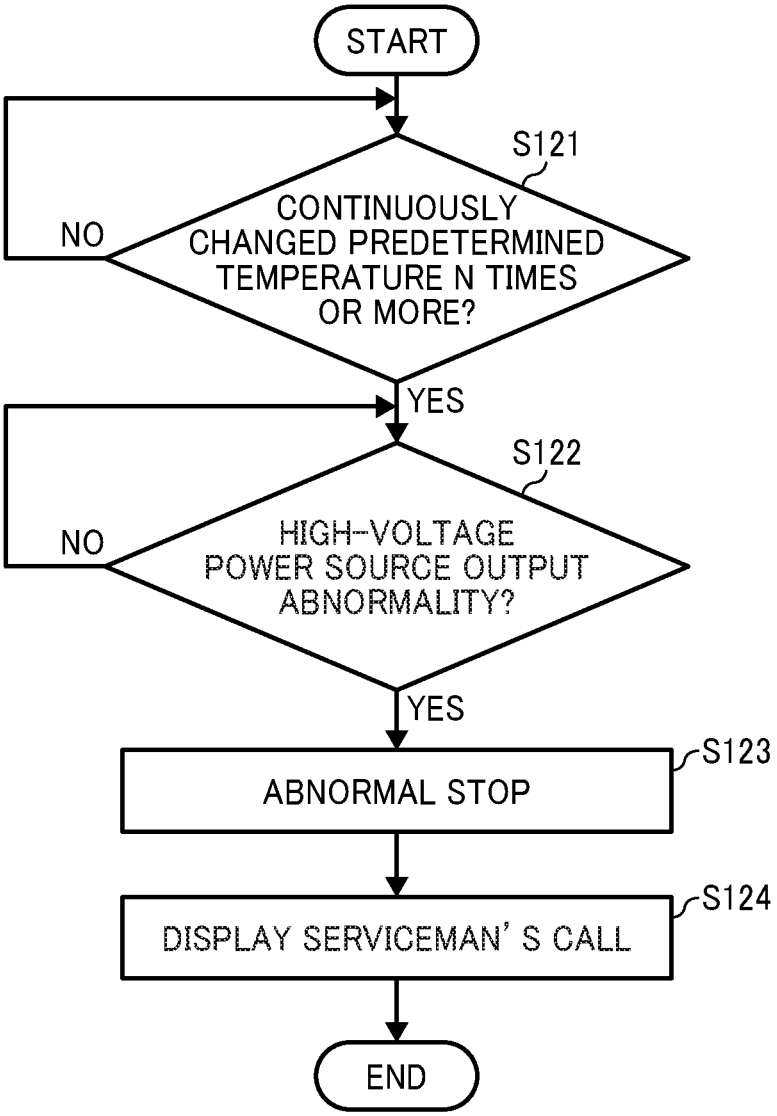
FIG. 19 is a flowchart of an operation sequence according to variation 6 of variation 5.

A description is given of variation 6 with respect to the prevention of abnormality in the third embodiment and variation 5, referring to FIG. 19. FIG. 19 is a flowchart of the operation sequence according to variation 6 in the third embodiment and variation 5. The operation sequence of FIG. 19 starts from step S121. The CPU 21 stops the operation of the image forming apparatus 1 when having changes the predetermined temperature Tn is changes N times or more (for example, three times) and detecting an abnormal output of the high-voltage power source (step S121 through step S124). In this case, "stop the operation of the image forming apparatus 1" refers to that the CPU 21 stops the image forming apparatus 1 under abnormal conditions and turns on the serviceman's call so that a user cannot use the image forming apparatus 1 until the serviceman fixes the image forming apparatus 1.

According to variation 6 in FIG. 19 as described above, the CPU 21 as a control circuit stops the operation of the image forming apparatus 1 when the abnormality detecting device (21*a* and 270) detects an abnormal output after continuous changes in predetermined temperature the predetermined numbers of times.

Such a configuration according to variation 6 reliably ensures safety in case that output abnormalities really occur.

Although the embodiments of the present disclosure have been described above, the present disclosure is not limited to the above-described embodiments and variations, but a variety of modifications may naturally be made within the scope of the present disclosure. For example, the technical features described in the above-described embodiments and variations may be combined as appropriate.

According to the above-described embodiments, a photoconductor is used as an example of an image bearer. However, the present disclosure is not limited to this configuration. Alternatively, in some embodiments, a belt-shaped photoconductor may be used as an image bearer.

In some embodiments, the image forming apparatus 1 may includes an intermediate transferor (for example, an intermediate transfer belt) onto which an image is transferred from an image bearer or an latent image bearer; a secondary-transfer device to form a secondary-transfer portion between the intermediate transferor and the secondary-transfer device; a voltage application device to apply a secondary-transfer voltage to the secondary-transfer device to transfer the image onto a transfer target as a sheet at the secondary-transfer portion; a temperature sensor to detect an ambient temperature; an abnormality sensor to detector an abnormal secondary-transfer voltage; and a controller. The controller controls the voltage application device to continue to apply the secondary-transfer voltage when the detection temperature of the temperature sensor is below a predetermined temperature, irrespective of whether the abnormality sensor detects an abnormality. Alternatively, in some embodiments, a belt-shaped transfer belt may be used instead of the transfer roller 14.

Numerous additional modifications and variations are possible in light of the above teachings. It is therefore to be understood that within the scope of the appended claims, the present disclosure may be practiced otherwise than as specifically described herein. Such variations are not to be regarded as a departure from the scope of the present disclosure and appended claims, and all such modifications are intended to be included within the scope of the present disclosure and appended claims. The number, position, and shape of the components of the image forming apparatus described above are not limited to those described above.

What is claimed is:

1. An image forming apparatus comprising:

an image bearer on which an image is formed;

a transfer device to form a transfer portion between the image bearer and the transfer device;

a voltage application device to apply a transfer voltage to the transfer device to transfer the image from the image bearer to a transfer target at the transfer portion;

an abnormality sensor to detect an abnormal level of the transfer voltage;

a temperature sensor to detect an ambient temperature; and a control circuit to control the voltage application device to continue applying the transfer voltage irrespective of whether the abnormality sensor has detected the abnormal level of the transfer voltage when a detection temperature of the temperature sensor is below a predetermined temperature.

2. The image forming apparatus according to claim 1, wherein the control circuit controls the voltage application device to stop applying the transfer voltage when the abnormality sensor detects the abnormal level of the transfer voltage at a detection temperature of greater than or equal to the predetermined temperature.

3. The image forming apparatus according to claim 1, further comprising an alarm to inform a reduction in image quality of a printed image when the control circuit controls the voltage application device to continue applying the transfer voltage at a detection temperature of below the predetermined temperature.

4. The image forming apparatus according to claim 3, further comprising a selection device to select whether to print an image after the alarm's informing.

5. The image forming apparatus according to claim 1, further comprising a setting unit to set one of a current value and a voltage value according to the detection temperature of the temperature sensor, wherein the control circuit controls the voltage application device based on the one of the current value and the voltage value set by the setting unit, wherein the setting unit sets the one of the current value and the voltage value such that a first set value at a detection temperature of below the predetermined temperature is different from a second set value at a detection temperature of greater than or equal to the predetermined temperature.

6. The image forming apparatus according to claim 5, wherein the setting unit reduces the first set value to be lower than the second set value.

7. The image forming apparatus according to claim 5, wherein the setting unit changes the first set value according to the detection temperature.

8. The image forming apparatus according to claim 7, wherein the setting unit reduces the first set value with a decrease in the detection temperature.

9. The image forming apparatus according to claim 1, further comprising a toner adhesion adjusting device to adjust an amount of toner adhering to the image bearer, wherein the control circuit controls the toner adhesion adjusting device to reduce a first toner adhesion amount at a detection temperature of below the predetermined temperature to be lower than a second toner adhesion amount at a detection temperature of greater than or equal to the predetermined temperature.

10. The image forming apparatus according to claim 9, wherein the control circuit controls the toner adhesion adjusting device to change the first toner adhesion amount according to the detection temperature.

11. The image forming apparatus according to claim 10, wherein the control circuit controls the toner adhesion adjusting device to reduce the first toner adhesion amount with a decrease in the detection temperature.

12. The image forming apparatus according to claim 1, further comprising a toner adhesion adjusting device to adjust an amount of toner adhering to the image bearer, wherein the control circuit controls the toner adhesion adjusting device to reduce a toner adhesion amount at a detection temperature of below another predetermined temperature that is lower than the predetermined temperature to be lower than the toner adhesion amount at a detection temperature of above the predetermined temperature.

13. The image forming apparatus according to claim 1, further comprising a counter to count and store elapsed time data of the transfer device, wherein the control circuit changes the predetermined temperature according to the elapsed time data.

14. The image forming apparatus according to claim 13, wherein the elapsed time data includes one of a travel distance of the transfer device, a number of sheets fed, and a driving time of the transfer device.

15. The image forming apparatus according to claim 13, wherein, when the abnormality sensor detects the abnormal level of the transfer voltage at a detection temperature above the predetermined temperature changed according to the elapsed time data, the control circuit further changes the changed predetermined temperature.

16. The image forming apparatus according to claim 13, wherein the control circuit increases the predetermined temperature.

17. The image forming apparatus according to claim 16, wherein the control circuit sets an upper limit of change of the predetermined temperature and prohibits changing the predetermined temperature when the increased predetermined temperature is equal to or greater than the upper limit.

18. The image forming apparatus according to claim 13, wherein the control circuit stops an operation of the image forming apparatus when the abnormality sensor detects the abnormal level of the transfer voltage after the control circuit changes the predetermined temperature a predetermined number of times in succession.

19. The image forming apparatus according to claim 1, wherein the control circuit changes the predetermined temperature when the abnormality sensor detects the abnormal level of the transfer voltage at a detection temperature of above the predetermined temperature.

* * * * *